US010463123B2

(12) United States Patent
Moskowitz et al.

(10) Patent No.: US 10,463,123 B2
(45) Date of Patent: Nov. 5, 2019

(54) WHEELED SUITCASE WITH AUXILIARY WHEELS ON LEGS AND UNDERCARRIAGE THEREFOR

(71) Applicants: Max Moskowitz, Kew Gardens, NY (US); Dov Katz, Brooklyn, NY (US); Bezalel Katz, Brooklyn, NY (US)

(72) Inventors: Max Moskowitz, Kew Gardens, NY (US); Dov Katz, Brooklyn, NY (US); Bezalel Katz, Brooklyn, NY (US)

( * ) Notice: Subject to any disclaimer, the term of this patent is extended or adjusted under 35 U.S.C. 154(b) by 185 days.

(21) Appl. No.: 15/453,602

(22) Filed: Mar. 8, 2017

(65) Prior Publication Data

US 2017/0172266 A1 Jun. 22, 2017

Related U.S. Application Data

(60) Division of application No. 12/686,834, filed on Jan. 13, 2010, now Pat. No. 9,615,638, which is a continuation-in-part of application No. 11/567,999, filed on Dec. 7, 2006, now abandoned.

(51) Int. Cl.

| | |
|---|---|
| ***A45C 13/30*** | (2006.01) |
| ***A45C 5/14*** | (2006.01) |
| ***A45C 13/26*** | (2006.01) |
| ***A45C 13/38*** | (2006.01) |

(52) U.S. Cl.

CPC ..... *A45C 5/146* (2013.01); *A45C 5/14* (2013.01); *A45C 13/262* (2013.01); *A45C 13/30* (2013.01); *A45C 13/385* (2013.01); *A45C 2013/267* (2013.01); *A45C 2013/306* (2013.01)

(58) Field of Classification Search

CPC ..... A45C 5/146; A45C 5/14; A45C 13/262; A45C 13/30; A45C 13/385; A45C 2013/267; A45C 2013/306

See application file for complete search history.

(56) References Cited

U.S. PATENT DOCUMENTS

| | | | | |
|---|---|---|---|---|
| 356,528 | A * | 1/1887 | Doughlas | 190/27 |
| 867,754 | A | 10/1907 | Randall | |
| 1,693,633 | A | 12/1928 | Allen | |
| 2,277,302 | A | 3/1942 | Chenette | |
| 2,581,417 | A | 1/1952 | Jones | |
| 2,663,048 | A | 12/1953 | Ross, Jr. | |
| 2,729,460 | A | 1/1956 | Forman | |
| 3,669,031 | A | 6/1972 | Cole | |
| 3,884,491 | A | 5/1975 | Hughart | |
| 4,258,826 | A | 3/1981 | Murray | |
| 4,284,286 | A | 8/1981 | Lewallen | |

(Continued)

*Primary Examiner* — Tri M Mai
(74) *Attorney, Agent, or Firm* — Ostrolenk Faber LLP

(57) ABSTRACT

A wheeling frame for a suitcase which has its own rolling wheels includes a frame supporting a pair of leaning wheels arranged at ends of a pair of pivotable legs, with a first wheel arranged at the end of a first leg and a second wheel arranged at the end of a second leg. The leg positions are adjustable between a stowed position and a deployed, adjustable position extending at an angle to the frame. The legs have a movable pivoting axis and adjustable lengths. A handle system at a proximal end of the frame is adjustable in length and angle, and is operable in conjunction with the leaning wheels to roll the suitcase in a stable leaning position, to allow walking the suitcase on steps of a staircase, and to be converted into a suitcase table, to ease packing and unpacking.

17 Claims, 32 Drawing Sheets

(56) References Cited

U.S. PATENT DOCUMENTS 4,310,166 A 1/1982 Eicher
4,545,592 A 10/1985 Taskovic
4,630,837 A 12/1986 Kazmark
4,852,705 A 8/1989 Cowan, Jr.
4,886,233 A 12/1989 Bateman et al.
4,982,820 A * 1/1991 Scott ..... A45C 9/00 190/13 R
5,024,458 A 6/1991 Kazmark et al.
5,100,163 A 3/1992 Egley et al.
5,275,365 A 1/1994 Gerbel et al.
5,431,262 A 7/1995 Rekuc et al.
5,813,503 A 9/1998 Chang
6,053,514 A 4/2000 Su
6,129,365 A 10/2000 Sadow
6,148,971 A 11/2000 Kho
6,164,425 A * 12/2000 Latshaw ..... A45C 5/14 190/108
6,240,987 B1 6/2001 Birkeland
6,279,740 B1 * 8/2001 Dorman ..... A63B 55/60 206/315.3
6,401,890 B1 * 6/2002 Tan ..... A45C 5/14 150/159
6,446,987 B2 * 9/2002 Abraham ..... A45C 5/14 190/18 A
6,769,701 B1 8/2004 Clausen
6,935,496 B2 * 8/2005 Chang ..... A63B 55/00 206/315.6
6,971,654 B2 12/2005 Amsili
7,011,195 B1 3/2006 Kho
8,033,369 B2 10/2011 Sherrell et al.
8,118,145 B1 * 2/2012 Hamamy ..... A45C 5/14 190/18 A
8,162,348 B2 4/2012 Thomas
2004/0216970 A1 11/2004 Sherrell et al.
2006/0151966 A1 * 7/2006 Murphy ..... A63B 55/00 280/47.26
2009/0160147 A1 6/2009 Arthur
2010/0236886 A1 9/2010 Herold
2011/0083933 A1 * 4/2011 Engel ..... A45C 7/0077 190/18 A

* cited by examiner

WHEELED SUITCASE WITH AUXILIARY WHEELS ON LEGS AND UNDERCARRIAGE THEREFOR

CROSS REFERENCE TO RELATED APPLICATION

This application is a divisional of Ser. No. 12/686,834, filed Jan. 13, 2010 and currently pending, which is a Continuation-In-Part (CIP) of U.S. application Ser. No. 11/567,999, filed Dec. 7, 2006 by Max Moskowitz et al., entitled WHEELED SUITCASE WITH AUXILIARY WHEELS ON LEGS AND UNDERCARRIAGE THEREFOR, the disclosure of which has been incorporated herein by reference.

FIELD OF THE DISCLOSURE

The present disclosure relates to the field of wheeled suitcases and, more particularly, to more easily rollable suitcases, namely, to wheeling frames for suitcases.

BACKGROUND OF THE DISCLOSURE

Wheeled upright luggage, including smaller carry-on bags or larger suitcases are well known. FIG. 1 shows a related art upright luggage 10 as it is being moved using a handle 12 on its top surface 13 and a set of wheels 16 attached to its bottom surface 14. Typically, the set of wheels 16 is comprised of two wheels separated by approximately the width of the luggage 10, one near each end of an edge of back surface 15, or of the bottom surface 14, to provide stability during movement of the suitcase. Bumpers 17, together with wheels 16, permit the luggage 10 to stand when not moving.

In such a conventional system, some of the weight of the suitcase, centered at point 18, is borne by the person pulling it. A considerable portion of the weight of the suitcase is located between the set of wheels 16 and the handle 12, therefore the set of wheels 16 do not necessarily bear all the weight during movement. The more tilted the luggage 10, the more weight is shifted to the side of handle 12. This fatigues the user, particularly when the suitcase is pulled on a rougher or less even surface, or over long distances.

U.S. Pat. No. 6,148,971 discloses luggage with front wheels provided on the bottom surface, two auxiliary wheels forward of two main wheels, with the main wheels are provided near the center of the bottom surface of the luggage. However, as shown in FIG. 2 of U.S. Pat. No. 6,148,971, when the person pulling the luggage walks normally, dragging the suitcase behind, the auxiliary wheels would typically be of no use, since they do not touch the ground between the main wheels and the handle. U.S. Pat. No. 7,011,195 shows a single auxiliary wheel, similar to that of U.S. Pat. No. 6,148,971, with a different handle, and an even greater loss of payload space inside the suitcase because of the V-shaped design of the bottom surface of the suitcase. Further, U.S. Pat. No. 6,129,365 discloses in FIG. 10 two pairs of wheels on the bottom surface of a suitcase. However, this arrangement requires the person pulling the suitcase to maintain the suitcase in a perfectly upright position substantially 90° to the ground. Also, moving the luggage in such an arrangement makes it difficult to walk in a normal fashion because there is insufficient clearance for the movement of the legs in a normal gait. The complete disclosures of the aforementioned U.S. patents are incorporated herein for all purposes by their reference.

Moreover, when the suitcase is in such a standing position suitable for pulling the suitcase, it is difficult, particularly in the case of a larger suitcase or of an elderly or frail person operating the suitcase, to open the suitcase and view its contents without squatting on the floor alongside the suitcase. Also, packing or unpacking the contents of the suitcase requires the use of a table, bed, stool or other such structure, on top of which the suitcase must be lifted and placed. A suitcase, and suitcase undercarriage system that overcomes these problems would be advantageous.

SUMMARY OF THE DISCLOSURE

In order to overcome these and other deficiencies of the prior art, provided according to the present disclosure is a suitcase having a body with opposing front and back sides, connected to one another by opposing top and bottom sides. A pair of main wheels is disposed on or adjacent to the bottom side of the suitcase. One or more support legs are adjustable from a first position against the back side of the suitcase, to a second position extending away from the suitcase, with one or more secondary wheels rotatably secured to the support leg. The suitcase stands inclined on the pair of main wheels and the secondary wheels.

In an alternate embodiment of the present disclosure, a suitcase includes a frame securable to a suitcase, having a ledge extending from a bottom portion of the frame. An optional pair of main wheels is permanently or removably attached to a bottom portion of frame, and one or more support legs are adjustable from a first position in the plane of the frame, to a second position extending away from the suitcase. One or more secondary wheels are rotatably secured to the support legs. The suitcase stands on the pair of main wheels and the one or more secondary wheels, in an inclined position. The suitcase can further include releasable straps, latches, clips, buckles and the like for securing the suitcase to the frame. The frame may include adjustable length members to accommodate various sizes of suitcases.

Either embodiment may include a handle secured on or adjacent to a top side of the suitcase or the frame, optionally telescopically extendable through a plane comprising to the top side of the suitcase or otherwise adjustable in length. Additionally, the handle may pivot about a lateral axis of the suitcase or suitcase frame or cart. The support legs may be urged towards the respective first position by a variable bias force, to accommodate variable weight of the suitcase.

The suitcase of the present disclosure may form a cart having a pair of secondary legs, optionally adjustable in length, pivotable between a first position against the back side of the suitcase, i.e., in the plane of the suitcase or frame, and a second position extending away from the suitcase, preferably substantially perpendicular to the back side of the suitcase. In a further embodiment, the secondary legs include tertiary wheels secured adjacent a distal end of the secondary legs.

An embodiment of the disclosure in the instant CIP application comprises a wheeling frame for wheeling a load which is rollable on its own load supporting wheels. The wheeling frame is not intended to have its own load supporting wheels. The frame defines a frame plane and the wheeling frame is removably securable to the load in such a manner that the load is rollable and the weight of the load is supported on its own load supporting wheels while only a portion of the weight of the load is supported in a leaning position on a wheeling leg assembly which is normally stowed in a space defined by the frame. The wheeling leg assembly is movable between a first position in the frame plane and a second, adjustable position, which extends at an angle to the frame plane. The wheeling leg assembly comprises at least one, and preferably two, spaced parallel legs whose members are extendible in length and each of which terminates in a respective leaning wheel.

A fastening system is structured to removably secure the wheeling frame to the load, which load is preferably a suitcase or piece of luggage, whereby when the wheeling frame is secured to the suitcase, the suitcase can be rolled on its own load supporting wheels while also leaning on the leaning wheels. In general, the objective is to have a frame which is rather thin and which may be encased in a bag and secured with straps to the suitcase to provide a look and feel which suggests that the wheeling frame and the suitcase are integral with one another.

BRIEF DESCRIPTION OF THE DRAWINGS

These and other features, advantages, and benefits of the present disclosure will become apparent from the following detailed description of the disclosure, which refers to the accompanying drawings, in which like reference numerals refer to like structures across the several views, and wherein.

DETAILED DESCRIPTION OF EMBODIMENTS OF THE DISCLOSURE

Figure 1:
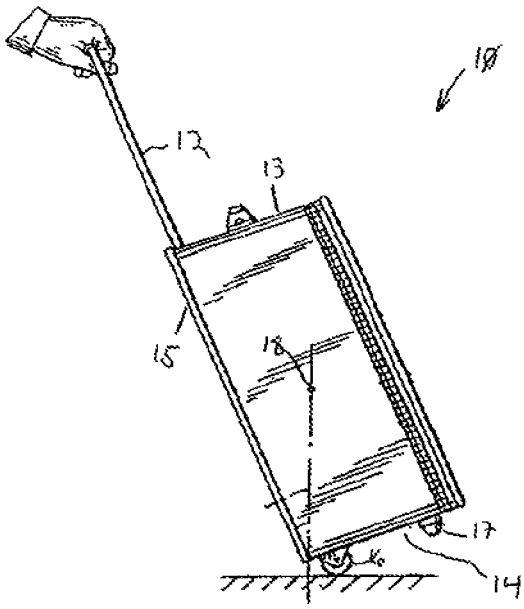
FIG. 1 PRIOR ART
FIG. 1 is a side view of a suitcase in a rolling position, according to the related art.

Referring to the drawings, as is obvious from their form and in accordance with long established patent practice in presentation of utility patents (as opposed to design patents), none of the drawings are drawn to scale. They are diagram and conceptual drawings that convey to one of ordinary skill in the art the underlying mechanical structure. Knowledge of basic mechanical structures such as telescoping arms, screws and bolts and the basics of connecting frame members to one another without interference is assumed.

Figure 2:
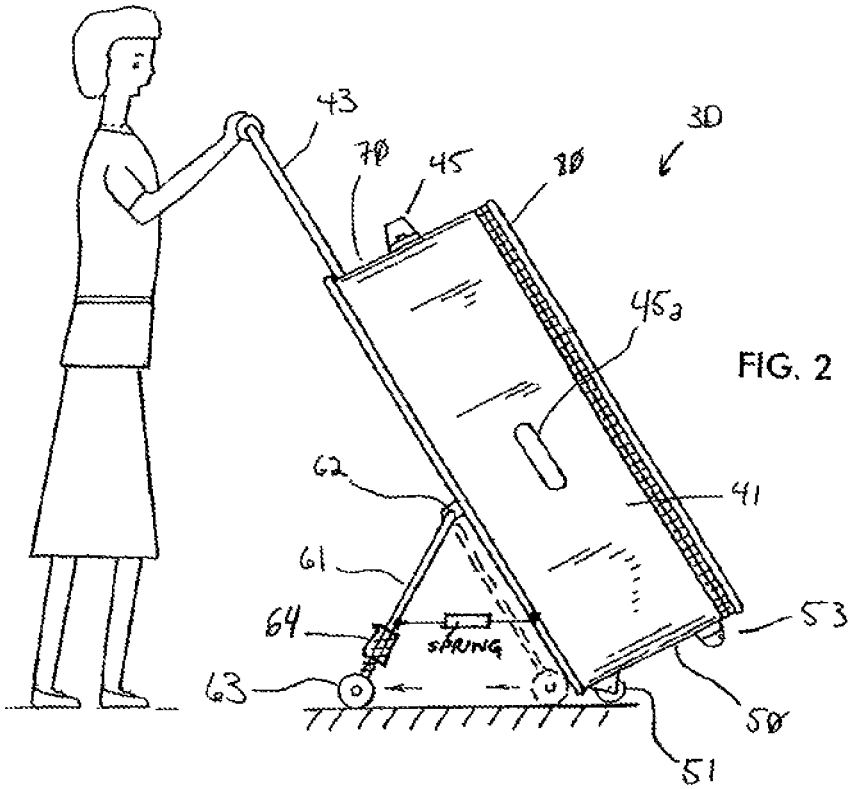
FIG. 2 is a side view of a movable suitcase, including main wheels, legs with auxiliary wheels and a handle, in a stable leaning/rolling position, according to a first embodiment of the present disclosure.

Referring to FIG. 2, illustrated is a side view of a movable suitcase, generally 30, in a leaning/rolling position according to a first embodiment of the present disclosure. Suitcase 30 includes main wheels 51 located at or near an intersection of the bottom surface 50 and the back surface 60 of the suitcase. A set of bumpers 53 is provided on the bottom surface 50, preferably comprising two bumpers located on either side of the bottom surface 50 and spaced from main wheels 51, more preferably at or near the intersection of the bottom surface 50 and the front surface 80.

A retractable handle 43 is mounted in the body 41 or on the back surface 60 at or near the top surface 70. Handle 43 extends up from suitcase 30 through a plane including the top surface 70 of the suitcase. Suitcase 30 may also have an additional handle 45 at the top surface 70 thereof and another lifting handle 45*a*. The handle 43 may be collapsible or telescoped and may be retractable into the main body 41 when not used. As is known, the handle 43 may be pulled out from the main body and extended when the user wishes to move the suitcase 30 in the standing/leaning position, by either pulling or pushing the suitcase.

A support leg 61 extends from the back surface 60 with an auxiliary wheel 63 at the distal end thereof. Auxiliary wheel 63 may comprise a plurality of wheels, and may be rotatably mounted to the support leg 61 on a fixed axis, or in a further embodiment, may be mounted by a pivotable castor in order to improve the rolling maneuverability of the suitcase 30.

FIG. 2 shows one support leg 61, though two are preferred, more preferably symmetrically disposed on the back surface 60 at or near either lateral side of the main body 41, for greater stability. In such an embodiment, the side view thereof would be unchanged. Three or more support legs are possible within the scope of the present disclosure, configured symmetrically or in some other fashion.

Leg 61 is shown in FIG. 2 extending from a point near to and preferably below the center of the bottom surface 60 of the suitcase 30. In the embodiment of FIG. 2 support leg 61 has a pivot 62 and is pivotably mounted to the suitcase 30, and pivotable between a first stowed position adjacent the back surface 60 of the main body 41, or more preferably recessed into the back surface 60 to be flush therewith, to a second deployed position extended away from the main body 41. The support leg 61 is preferably pivotably securable in at least the deployed position, and more preferably also in the stowed position, and even more preferably at a plurality of adjustable positions therebetween. The support leg 61 may further be arranged and secured at a position substantially perpendicular to the back surface 60, which perpendicular position optionally is coincident with the deployed position.

Optionally, the pivot 62 can be a ratcheting type of connection that allows selection of the precise angular position of a leg(s) 61 relative to the bottom surface of the suitcase. Further, the length of the leg 61 may be adjustable by constructing it as several telescoping members as indicated symbolically by reference numeral 64. As another option, for increased strength and adjustability, a lateral bar 65 extends between the leg 61 and the bottom surface of the suitcase. A hinge 66 allows the lateral bar 65 to fold and to collapse when the leg 61 is folded toward the bottom of the surface. Reference numeral 67 indicates that the lateral bar has a length which is telescopically adjustable to adjust and hold the angle of inclination of the leg 61 relative to the suitcase. The lateral bar may be fixed to the bottom surface by a variable length spring which provides a shock absorbing and inherent adjustment of the angle. Alternatively, the spring can be provided separately between the leg and the suitcase. If the spring has sufficient "give", the separation distance between the main wheels and the support legs would be adjusted by applying a force to the suitcase handle, to cause the two to separate further. This feature enables a user to "walk" the suitcase up a staircase without having to "lift" the suitcase, as one or the other of the main wheels or the wheels on the support legs rests on the steps. This similarly allows the suitcase to be "walked" down a staircase.

As the suitcase 30 rests in a leaning/rolling position supported by each of main wheels 51 and auxiliary wheel(s) 63 inclined to the back surface 60, its center of mass is stably located above a perimeter circumscribing and defined by main wheels 51 and auxiliary wheels 63. Therefore, a user may roll the suitcase 30 by acting upon handle 43 (pulling or pushing) without bearing any of the weight of the suitcase 30, thereby increasing mobility and ease of use, and reducing user fatigue. At the same time, the user pulling the handle 43 may be able to maintain a normal gait because sufficient clearance for his/her legs may be provided.

Figure 3:
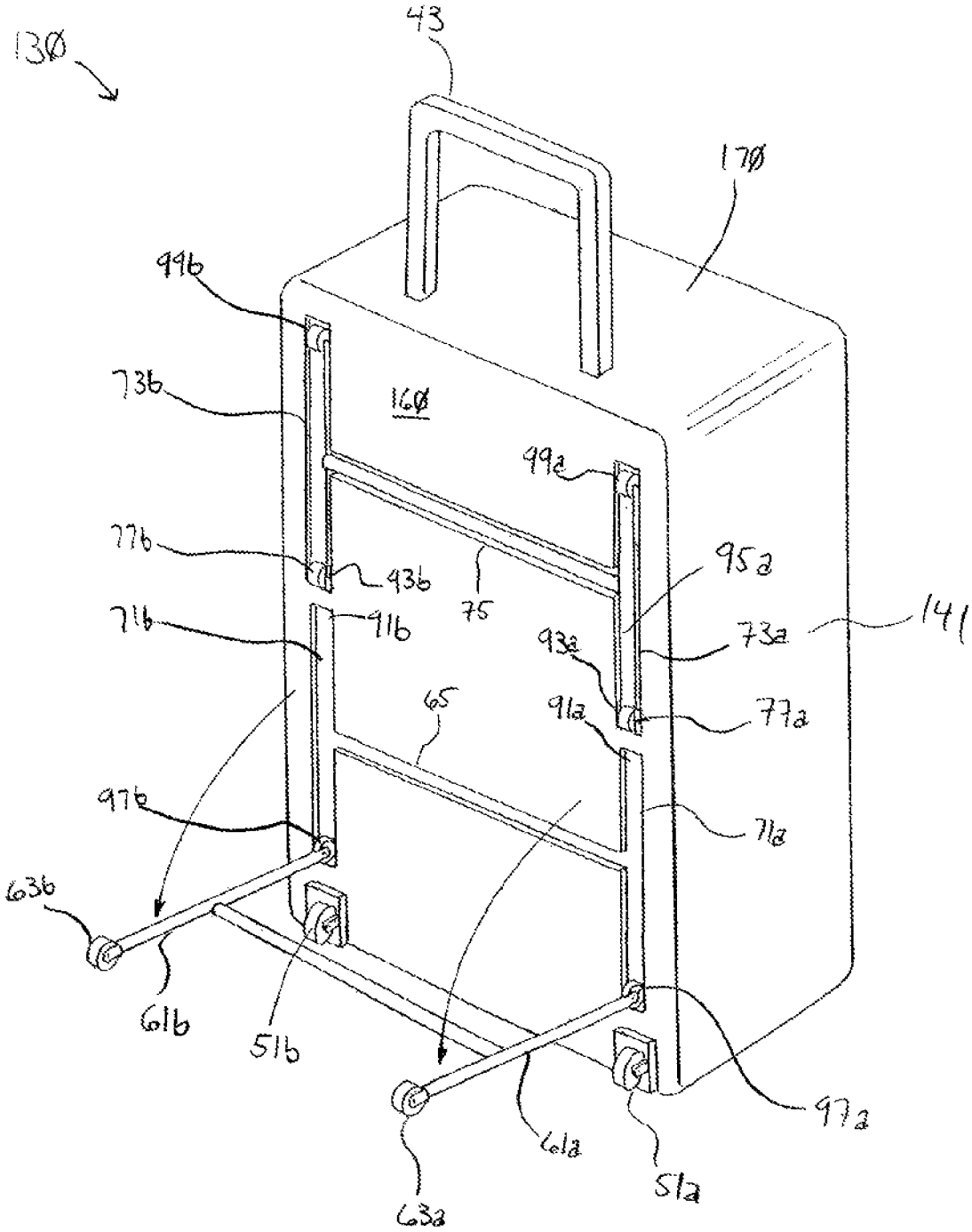
FIG. 3 is a perspective view of a suitcase, illustrating structures on and extending from the back suitcase surface, according to a second embodiment of the present disclosure.

Turning now to FIG. 3, illustrated in perspective view is a suitcase 130, with structures on and extending from the back surface 160 thereof, according to a second embodiment of the present disclosure. FIG. 3 shows a first pair of support legs 61*a* and 61*b*, located on either side of the back surface 160. Auxiliary wheels 63*a* and 63*b* may be located at distal ends of the legs 61*a* and 61*b*, respectively, secured as described in the previous embodiment. Thus, when legs 61*a* and 61*b* are in the deployed position as shown in FIG. 3, the suitcase 130 may be rolled on main wheels 51*a* and 51*b* and auxiliary wheels 63*a* and 63*b* by the user pulling or pushing on the handle 43. Similar benefits inure to this embodiment as to the first embodiment described above.

In the embodiment shown in FIG. 3, support legs 61*a* and 61*b* are illustrated in a deployed position, and are pivotably connected with the suitcase body 141 at or near the intersection of the back surface 160 and the bottom surface (not shown) of the suitcase 130. Support legs 61*a* and 61*b* may be pivoted to a stowed position wherein they are flush, sunken into, or substantially near the back surface 160 of the suitcase 130. In a further embodiment, in the stowed position support legs 61*a* and 61*b* are received within guides 71*a* and 71*b*. Guides 71*a*, 71*b* may be grooves, recesses, rods or other types of structures at, in or on the back surface 160. Guides 71*a*, 71*b* more preferably additionally accommodate auxiliary wheels 63*a*, 63*b*, respectively, for example at latches 91*a*, 91*b*. When in the stowed position within guides 71*a*, 71*b*, support legs 61*a*, 61*b* are generally flush with the back surface 160. Support legs 61*a*, 61*b* may be secured into place in this stowed position by latches anywhere along the length of the support legs 61*a*, 61*b*, including at the point of pivotal attachment 97*a*, 97*b*. In that case, a single latch (per leg or collectively) may selectively secure the support legs 61*a*, 61*b* in the stowed, deployed, or at some other position. Alternatively, guides 71*a*, 71*b* may be dispensed with, and securing latches at recesses 91*a*, 91*b* alone could be designed to do the job of securing the support legs 61*a* and 61*b* in the stowed position.

Alternately, or in addition to guides 71*a*, 71*b*, a further transverse guide 65, or several of them, may be provided. Rather than collapse longitudinally into guides 71*a*, 71*b*, support legs 61*a*, 61*b* may fold laterally into a stowed position within transverse guide 65.

In a further embodiment, auxiliary wheels 63*a*, 63*b* may be rotated upon folding support legs 61*a*, 61*b* into the stowed position, so as to be folded into or be flush with the bottom surface. That is, auxiliary wheels 63*a*, 63*b* are generally disposed to point in the same direction as the main wheels 51*a*, 51*b* when in the deployed position, but may be rotated about the axis of support legs 61*a*, 61*b* so that they align with the back surface 160 and are thus less obtrusive in the stowed position.

In a further embodiment of the present disclosure, alternately or additionally to above, the bases of the support legs 61*a*, 61*b* may be slidably moved in their respective guides 71*a* 71*b*, to a desired position, in order to control the angle of inclination of the suitcase. In yet a further embodiment, alternately or additionally to above, the support legs 61*a*, 61*b* are adjustable in length, thereby further controlling the angle of inclination of the suitcase 130 in a standing/rolling position. The angle between the support legs 61*a*, 61*b* and the back surface 160 may be selectively fixed by a latching mechanism at the point of pivotal attachment 97*a*, 97*b*, at the extremes of the range of pivotal motion of the support legs 61*a*, 61*b*, which is typically, though not exclusively, the stowed and deployed positions, but more preferably at any position therebetween. The deployed position may also coincide with an approximately perpendicular position between the support legs 61*a*, 61*b*, and the back surface 160, which is also useful for a table configuration to be explained, infra.

In yet a further embodiment, the support legs 61*a*, 61*b*, or even a third or more of the support legs can be slidably disposed in a single guide 71*a*, preferably centrally disposed on a back side 160. The deployed position of each support leg 61*a*, 61*b* can be extending away from the back surface 160 of the suitcase 130, and also away from each other, particularly with respect to auxiliary wheels 63*a*, 63*b*. More preferably in the embodiment having a single guide 71*a*, when support legs 61*a*, 61*b* are in the deployed position, the points of pivotal attachment 97*a*, 97*b* are as close with one another on the single guide 71*a* as is practicable.

Also illustrated in FIG. 3, is a second pair of guides 73*a*, 73*b*, associated with a second pair of support legs 95*a*, 95*b*, each optionally having optional, auxiliary wheels 77*a*, 77*b*. Alternately, guides 71*a*, 71*b* may extend the length of the back surface 160, effectively guides 71*a*, 73*a*, and 71*b*, 73*b*, into a single pair of guides. A second transverse guide 75 is also illustrated, and is analogous to transverse guide 65 as previously described. Second support legs 95*a*, 95*b* are pivotably attached to guides 73*a*, 73*b*, respectively, and are more preferably selectively securable in a stowed position at one end of the pivotal range of motion and against the back surface 160, and also in an extended position, which is preferably at an opposite end of the range of motion, and more preferably approximately perpendicular to the back surface 160. Second support legs 95*a*, 95*b* are further preferably adjustable in length. Auxiliary wheels 77*a*, 77*b*, if provided, are receivable within latches 93*a*, 93*b* to be flush with back surface 160. Alternately, auxiliary wheels 77*a*, 77*b* are rotatable about the axes of the second support legs 95*a*, 95*b*, to be flush with back surface 160, as described with reference to auxiliary wheels 63*a*, 63*b*.

Figure 4:
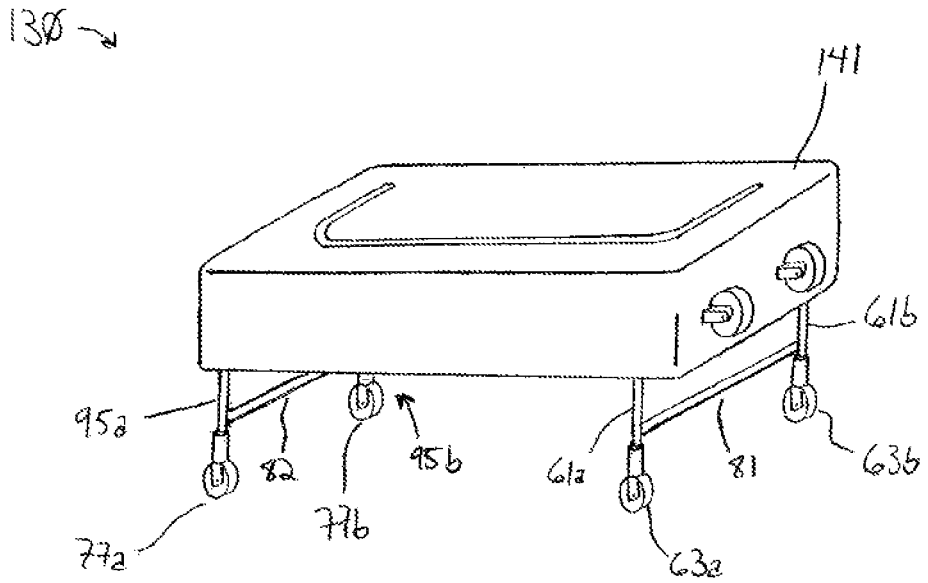
FIG. 4 is a line drawing of the movable suitcase illustrated in FIG. 3 in a table mode, according to the second embodiment of the present disclosure.

FIG. 4 illustrates a perspective line drawing of the movable suitcase illustrated in FIG. 3 in a table mode. In the table mode, suitcase 130, with support legs 61*a*, 61*b* in the deployed position, and also showing second pair of legs 95*a*, 95*b* at a generally opposite side of the back surface 160 of the suitcase 130. In such a table mode, it is unnecessary to place the suitcase 130 on a table, bed, stool or other such structure, since the support legs 61*a*, 61*b* and secondary support legs 95*a*, 95*b* provide a built-in stand when opened to provide for convenient viewing and packing and unpacking access to the main body 141.

Figure 5:
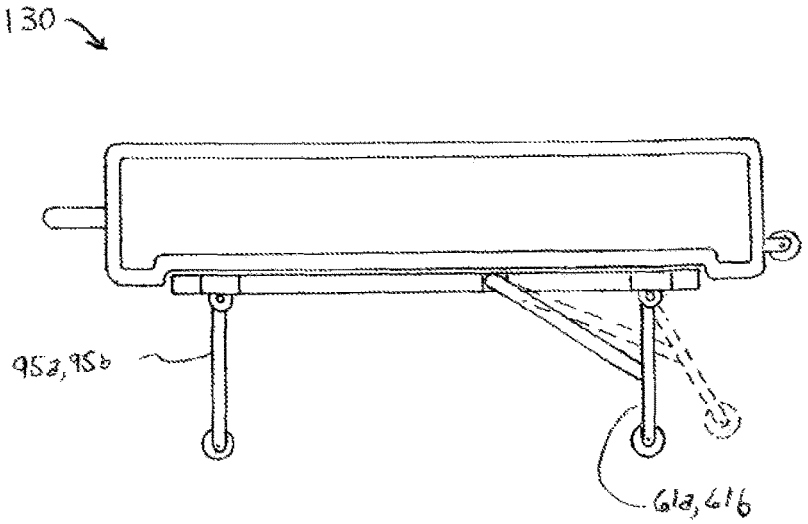
FIG. 5 is a side view of a movable suitcase in a table mode, according to a third embodiment of the present disclosure.

When all four legs 61*a*, 61*b* and 95*a*, 95*b* have auxiliary wheels 63*a*, 63*b* and 77*a*, 77*b*, it is easier to move the suitcase 130 in the table mode. For example in a hotel room, after the suitcase 30 is in the table mode, it is easier to roll the suitcase 32 to other positions or places in the room when all the legs have wheels. In the table mode the contents of the main body 141 are easier to access, remove or replace because in their elevated table mode. It is comparatively easier to tilt the suitcase 130 into a table mode, with all support legs extended, than to lift it onto a separate supporting structure. Alternatively, when legs 95*a*, 95*b* are not provided with auxiliary wheels 77*a*, 77*b*, the legs 95*a*, 95*b* and the undercarriage system as a whole may be less cumbersome and less costly. Even with only auxiliary wheels 63*a*, 63*b*, it is comparatively easier to lift only one end of the suitcase 130 while in table a mode, and reposition it on a single pair of auxiliary wheels 63*a*, 63*b*, than to lift the entire suitcase 130. Any or all of support legs 61*a*, 61*b* and secondary legs 95*a*, 95*b* may be adjustable in length, to choose a desired table height, e.g. 30 to 36 inches. While it is preferred that the legs be substantially perpendicular to the back surface 160, this is not necessary, and the height of the suitcase 130 in table mode may be adjusted by adjusting the position of support legs 61*a*, 61*b* or secondary legs 95*a*, 95*b*, illustrated for example in FIG. 5.

Referring now back to FIG. 4, a stabilizer bar 81 may be provided to connect the support legs 61*a*, 61*b*, as shown in FIG. 4. Stabilizer bar 81 may be disposed at or near the centers of support legs 61*a*, 61*b* to provide stability and longer use for the support legs 61*a*, 61*b*. Similarly, a second stabilizer bar 82 may be provided to connect legs 95*a*, 95*b*, with similar benefit. According to an aspect of the present disclosure, the stabilizer bar may be more important on the legs whose wheels are primarily used in the first position for moving the suitcase in the standing mode because they would bear more stress.

According to another embodiment of the present disclosure, secondary support legs 95*a*, 95*b* may be moved to a deployed position and along guides 71*a*, 71*b* to position auxiliary wheels 77*a*, 77*b* in place of auxiliary wheels 63*a*, 63*b*, for the leaning/rolling mode of the suitcase 130. That is, secondary support legs 95*a*, 95*b* may be used, in addition to or instead of support legs 61*a*, 61*b*, as the legs on whose wheels suitcase 130 is rolled in the standing/rolling mode shown in FIG. 2.

According to yet a further embodiment of the present disclosure, the support legs 61*a*, 61*b* are elastically biased against the weight of the suitcase 130. The bias acts to increase the size of the perimeter circumscribing and defined by main wheels 51 and auxiliary wheel 63, and thus improve stability, when the weight of the suitcase 130 is particularly heavy. In one particular embodiment, the design criteria call for a strong frame capable of supporting at least a suitcase weight of 150 pounds. One means of bias is a torsion or tension spring acting on the support legs 61*a*, 61*b*, and tending to bias them in a clockwise direction, as viewed in FIG. 2. Alternately or additionally, where the point of attachment 97*a*, 97*b* is freely longitudinally slidable with guides 71*a*, 71*b*, that point of attachment may be biased towards the bottom surface 150, to resist an increased weight of suitcase 130 while spreading the distance between auxiliary wheels 53*a*, 53*b* and main wheels 51.

Figure 6:
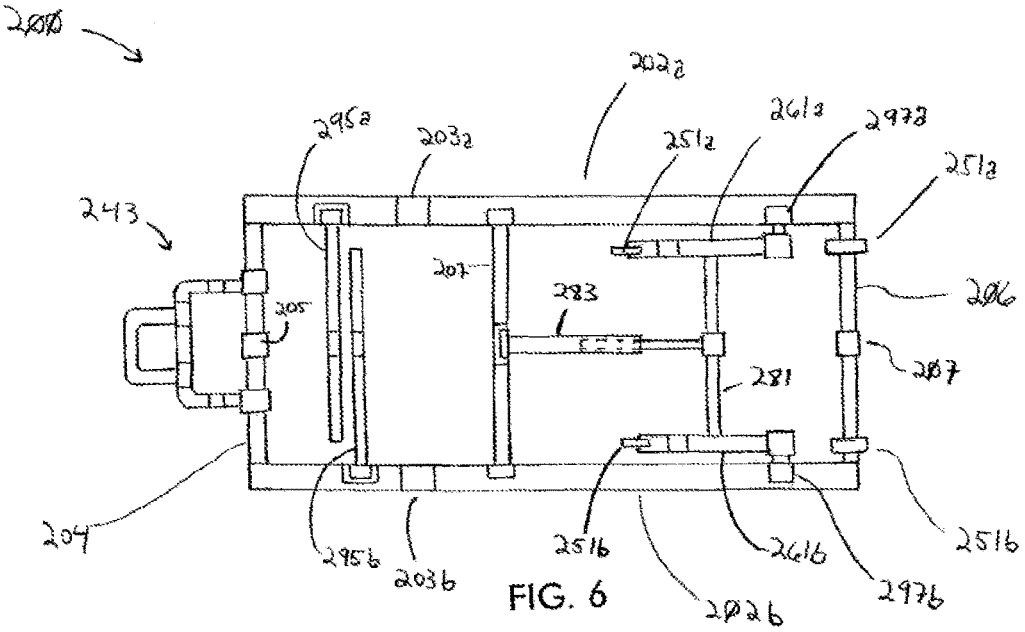
FIG. 6 is a plan view of a wheeling frame attachable to a suitcase according to a fourth embodiment of the present disclosure.

Referring now to FIG. 6, illustrated in plan view is a wheeling frame, generally 200, attachable to a suitcase according to a further embodiment of the present disclosure. Wheeling frame 200 has many features generally in common with the previous embodiments, the structure and operation of which will be apparent with simply a naming thereof, in view of the forging discussion. Wheeling frame 200 has longitudinal frame members 202*a*, 202*b*, which may optionally be adjustable in length as indicated at 203*a*, 203*b*, to accommodate suitcases of various sizes. Top lateral frame member 204 and bottom lateral frame member 206 each connect longitudinal frame members 202*a*, 202*b* with each other, and both may also be adjustable in length as indicated at 205 and 207, respectively. Main wheels 251*a*, 251*b* are rotatably mounted to bottom lateral frame member 206. A handle 243 is pivotably attached to the top lateral frame member 204, and may be adjusted in length as indicated at 244, or width, either together with or separately from top lateral frame member 204. The handle 243 is preferably selectively fixable in position with respect to top lateral frame member 204. A further pivotable hand pull 246 may depend from handle 243. The features of handle 243 may also be incorporated into the foregoing embodiments of the present disclosure, or alternately, a telescoping handle as described with respect to those embodiments may be substituted in the embodiment of FIG. 6.

Secondary support legs 295*a*, 295*b* are pivotably attached to longitudinal frame members 202*a*, 202*b*, respectively, and as exemplary only, are pivoted laterally into a stowed position. Secondary support legs 295*a*, 295*b* may also be longitudinally slidable or repositionable along longitudinal frame members 202*a*, 202*b*, as well as adjustable in length.

Support legs 261*a*, 261*b* are pivotably attached to longitudinal frame members 202*a*, 202*b*, respectively, and attached to one another by stabilizer bar 281. The points of attachment 297*a*, 297*b* between support legs 261*a*, 261*b* and longitudinal frame members 202*a*, 202*b* may also be longitudinally slidable or repositionable. Stabilizer bar 281 is connected by a brace member 283, which may be adjustable in length, to medial lateral frame member 207. Medial lateral frame member 207 may be longitudinally slidable or repositionable along longitudinal frame members 202*a*, 202*b*. Additionally, the stowed position of the support legs 261*a*, 261*b* may orient the auxiliary wheels 253*a*, 253*b* upwards towards the top lateral frame member 204, for example as shown in FIGS. 6 and 7A, or downwards towards bottom lateral support member 206.

From a stowed position, support legs 261*a*, 261*b* are deployable to an extended position for a leaning/rolling mode in a number of ways. Brace member 283 may be lengthened to extend the support legs 261*a*, 261*b* by pivoting at 297*a*, 297*b*. Alternately or additionally, medial lateral frame member 207 may be positioned downward to accomplish a similar effect. Alternately or additionally, the points of attachment 297*a*, 297*b* may be relocated upward to extend support legs 261*a*, 261*b*.

Figure 7:
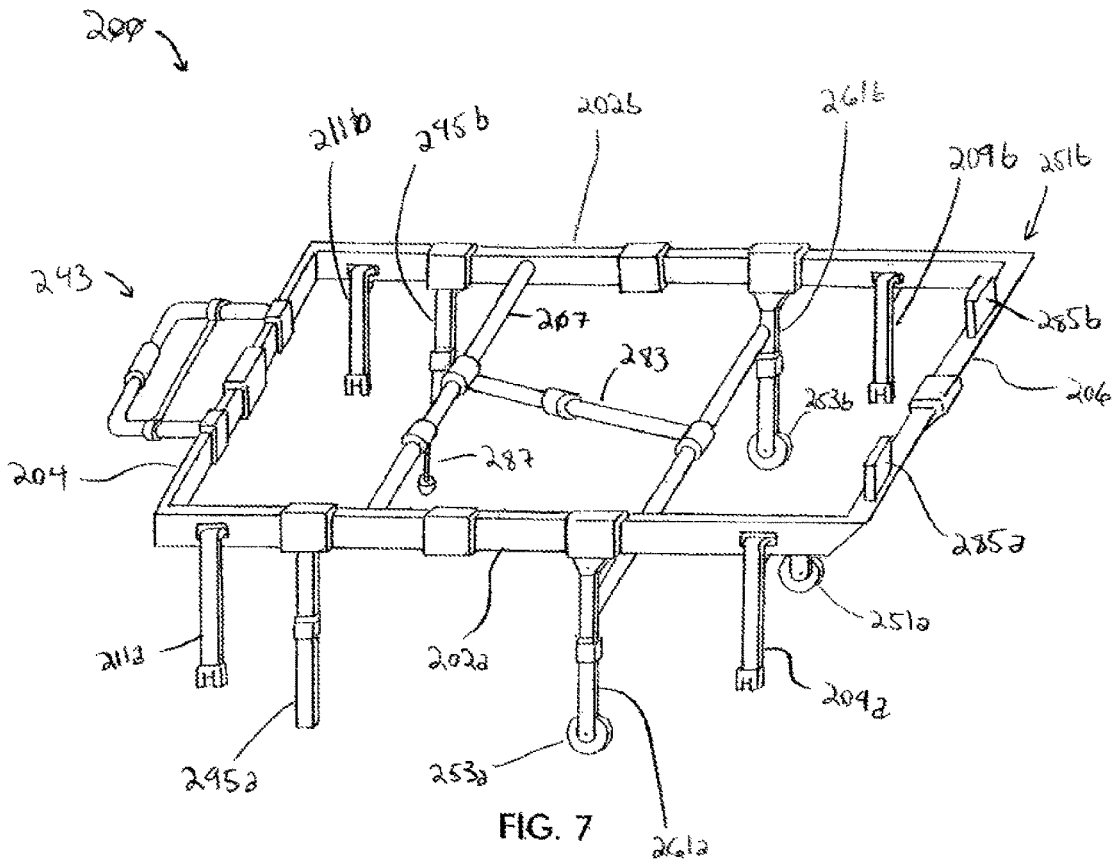
FIG. 7 is a perspective view of a wheeling frame attachable to a suitcase similar to the frame illustrated in FIG. 6, according to the fifth embodiment of the present disclosure.
Figure 7A:
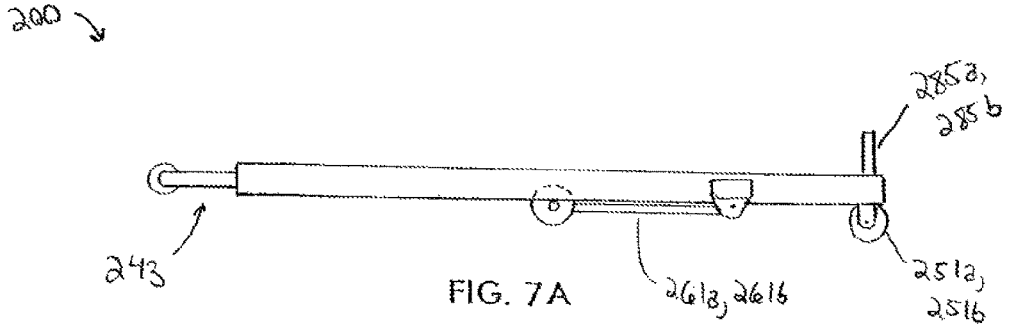
FIG. 7*a* is a side view of the wheeling frame of FIG. 7, in a collapsed mode.

Turning to FIG. 7, illustrated is a perspective view of the wheeling frame 200 of FIG. 6, in a table mode. In table mode, the frame 200 stands upon support legs 261*a*, 261*b* and secondary legs 295*a*, 295*b*, which can be, but need not be, substantially perpendicular to the plane of the wheeling frame 200 as defined by frame members 202*a*, 202*b*, 204 and 206.

Also visible in FIG. 7 are two halves of a first strap 209*a*, 209*b*, which together encircle and secure a suitcase (or even two suitcases) to the wheeling frame 200. Optionally a plurality of such straps, including both halves of a second strap 211*a*, 211*b*, can secure the suitcase to the wheeling frame 200. Optionally, strap halves 209*a*, 211*a* can be secured to opposing halves 209*b*, 211*b* by a releasable buckle. Alternately or additionally, in place of the described straps, straps may extend from a suitcase(s) to secure it (them) to the wheeling frame 200. Alternately or additionally, straps may extend longitudinally, heightwise relative to the suitcase to secure it to the wheeling frame 200. In a further embodiment, in place of or in addition to straps on either the suitcase or the wheeling frame 200, releasable latches, clips, buckles or the like may connect the wheeling frame 200 to the suitcase.

Also illustrated in FIG. 7 are one or more support shelves 285*a*, 285*b*, upon which the suitcase is supported when secured to the wheeling frame 200 and in the standing/rolling mode. To improve the compact profile of the wheeling frame 200 in a folded mode, the support shelves 285*a*, 285*b* preferably extend out of the plane of the wheeling frame 200, as defined by frame members 202*a*, 202*b*, 204 and 206, the minimum amount necessary to reliably support the suitcase(s). Optionally, support shelves 285*a*, 285*b* can fold into the plane of the wheeling frame 200 when not in use.

Also shown in FIG. 7 is an optional plumb bob 287. Plumb bob 287 is pivotably attached to the wheeling frame 200 to pivot at least about an axis parallel to the bottom lateral frame member 206. In the embodiment shown, merely as an example, the plumb bob 287 is pivotably attached to the medial lateral frame member 207. The plumb bob 287 serves a visual indicator of the approximate center of mass of the wheeling frame 200, particularly when attached to a suitcase, and help to visually confirm the center of gravity being within the perimeter circumscribing and defined by main wheels 251*a*, 251*b*, and auxiliary wheels 253*a*, 253*b* when the wheeling frame is in a leaning/rolling mode. The plumb bob 287 is also optionally movable to approximately coincide with the center of gravity of the particular suitcase depending upon weight and loading for each instance. Moreover, the plumb bob 287 may also be adapted to any of the foregoing embodiments of the present disclosure.

Turning now to FIG. 7*a*, illustrated is a side view of the wheeling frame 200 of FIG. 7, in a collapsed mode. In the collapsed mode, support legs 261*a*, 261*b* and secondary support legs 295*a*, 295*b* fold substantially or completely into the plane of the wheeling frame 200 as defined by frame members 202*a*, 202*b*, 204 and 206. In fact, if the wheels are castered, they will automatically become flush with the frame with no protruding portion. Handle 243 is also in the same plane, and can extend outward as shown, or alternately fold inward within the area defined by frame members 202*a*, 202*b*, 204 and 206. Support shelves 285*a*, 285*b*, extend out of plane the minimal amount necessary, and may optionally fold into the plane of the wheeling frame 200 as defined by frame members 202*a*, 202*b*, 204 and 206. Moreover, in accordance with a further embodiment, the wheels 251*a*, 251*b* and their supports may be folded into the frame. It is contemplated that the main load bearing components including the wheels be made of a very strong but light metal, e.g. steel, aluminum, titanium, or alloys having one or more of these, among other suitable materials. The folded thickness of the frame is preferably an inch or no more than 2-4 inches. The wheels and their bearing balls may be made of strong metal (with a plastic/synthetic cover), rendering them virtually indestructible.

Figure 8:
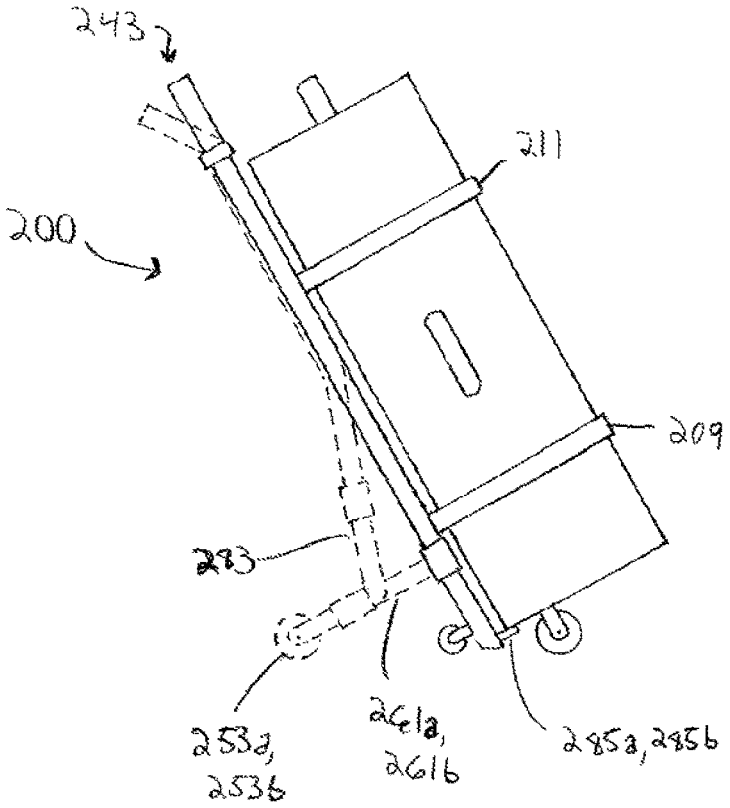
FIG. 8 is a side view of a wheeling frame of FIG. 7, attached to a suitcase and in a leaning/wheeling mode.

Referring now to FIG. 8, illustrated is a side view of a wheeling frame of FIG. 7, attached to a suitcase and in a standing/wheeling mode. In the description of the embodiment of FIGS. 7, 7*a* and 8, the wheeling frame is shown with main load bearing wheels 251*a*, 251*b* and with support shelves 285*a* and 285*b*. In accordance with a further implementation of the wheeling frame of the present disclosure, the same can be constructed without including the aforementioned structure such that the suitcase would be attached to the frame solely with the straps 211*b*, 209*b*, etc. In this instance, the suitcase would be able to be rolled along on its own wheels, with the wheels 253*a* and 253*b* being utilized for inclining the suitcase as shown in FIG. 8.

Figure 9:
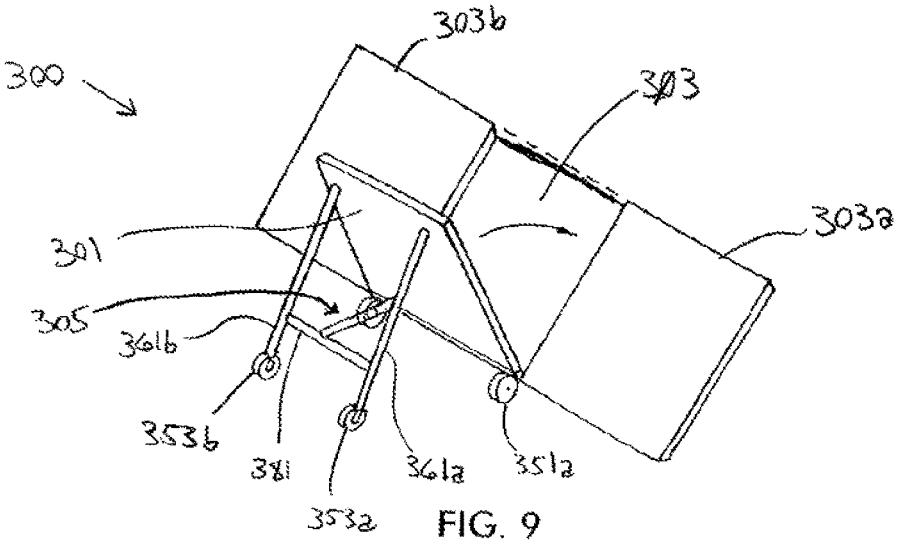
FIG. 9 illustrates a perspective view of a wheeling frame according to a sixth embodiment of the present disclosure.

Referring now to FIG. 9, illustrated in perspective view is a wheeling frame, generally 300, according to further embodiment of the present disclosure. Wheeling frame 300 has many features generally in common with the previous embodiments, the structure and operation of which will be apparent with simply a naming thereof, in view of the foregoing discussion. Wheeling frame 300 is intended to be secured to a suitcase, for example by straps, clips, or the like, as shown in the prior figures. The wheeling frame 300 includes a back side 301 and a bottom side 303. Main wheels 351*a*, 351*b* are rotatably mounted at or near an intersection of back side 301 and bottom side 303. Bottom side 303 may optionally include fold-out panels 303*a*, 303*b* to increase the surface area for carrying a suitcase. A further fold-out panel (not shown) may extend from a forward edge of the bottom side 303. Back side 301 extends only as far as necessary to support the proximal ends of pivotable support legs 361*a*, 361*b*, with auxiliary wheels 353*a*, 353*b*, for example, a foot or so. A stabilizer bar 381 connects support legs 361*a*, 361*b* with one another, and is itself connected with the back side 301 of wheeling frame 300 by scissor link 305. Other configurations are possible, particularly those including features described with respect to the embodiments disclosed above.

When secured to a suitcase, the suitcase and wheeling frame 300 stand in a stable manner supported on the main wheels 351*a*, 351*b* and auxiliary wheels 353*a*, 353*b*. In this standing/rolling mode, the suitcase and wheeling frame 300 may be pulled, for example by a handle already provided on the top of the suitcase. For transit of the suitcase by other means, for example when handled by baggage handling personnel of a common carrier airline, the wheeled frame can remain attached to the suitcase. Support legs 361*a*, 361*b* fold to a stowed position adjacent the back side 301. Preferably, one or both of fold-out panels 303*a*, 303*b* extend over bottom side 303 in a stowed position to cover and/or protect the main wheels 351*a*, 351*b*. In one embodiment, each of two panels may cover only one wheel. As compared to the previous embodiments, the reduced size of wheeling frame 300 makes it lighter and easier to transport, particularly in connection with an eventual lifting of the suitcase. Towards that end, any of back side 301, bottom side 303, or fold-out panels 303*a*, 303*b* may have material removed therefrom to reduce weight without sacrificing function.

It will further be appreciated that the wheeled frame 300 may be integrated with the suitcase itself, and further that the deployment of support legs 361*a*, 361*b* can be triggered by a remote action, for example by extending a telescoping handle 43.

As described above, the present disclosure provides suitcases and/or wheeling frames for suitcases that facilitate one's ability, particularly the elderly or frail person's ability, to carry larger size suitcases over long walkways in airports and the like. Prior art suitcases which have front and rear rolling wheels spaced along the width of the suitcase are notoriously unstable with the suitcase oftentimes falling to the right or to the left. The embodiments illustrated in FIGS. 2-5 integrate in such suitcases a second pair of wheels which allow the suitcase to lean without falling, while enabling the user to pull or push the suitcase by holding the handle 43. In any of the foregoing embodiments, one can rest along any long pathway in a walkway in an airport without having to return the suitcase to an upright position. The tilting angle is adjustable and the mechanism is made out of extremely light and highly durable components. If desired, the handle 43, can be constructed not only to pull out of the suitcase but also to tilt relative to the suitcase to adjust the height of the distal end of the handle to suit the needs of different people.

The suitcase design of the aforementioned FIGS. 2-5 also provides the benefit of an optional extra pair of legs which allow the suitcase to be tilted and to be held in a table mode as described.

The various embodiments of the wheeling frames which are illustrated in FIGS. 6-9 provide similar benefits and additional benefits as well. For example, if the wheeling frames are provided without their main load bearing wheels 251*a* and 251*b*, the suitcase can be rolled on its own wheel and the frame used merely for supporting a conventional suitcase in an inclined position, with the frame being able to be collapsed or folded into a very flat and thin construction whereby it does not have to be removed from the suitcase and can travel with the suitcase, in the suitcase bin of an airplane. For example, the aforementioned wheeling frames can have covers at the bottom of the wheel frame when the auxiliary wheel and the support legs are folded in their stowed position. This will enable a suitcase to be handled by luggage handlers at the airport without having to remove the wheeling frame from the suitcase.

The embodiments where the main wheels 251*a* and 251*b* are included provide the benefit to luggage makers of selling suitcases which do not have wheels at their bottom, relying on only the wheeling frame. This enables providing to the traveling public less expensive and lighter suitcases which do not have to be reinforced at their bottom to support wheels. The wheeling frames described herein can be made of extremely strong material yet light as described above, and be virtually unbreakable. This would avoid the consumers having to constantly buy new luggage because of the tendency of the wheels of the standard luggage breaking or being damaged. As noted, at least two suitcases can be strapped to a single wheeling frame.

Relative to the embodiment of FIG. 9, it bears mentioning that the structure that provides for the frame to incline is merely an optional feature. The frame can be provided in the form whereby it merely supports the rolling wheels 351*a* and 351*b* and has the means, e.g. various straps and the platform on which a suitcase can be supported and to which the frame can be attached. Again, the concept of this embodiment is that luggage makers need not provide wheels and merely use the device of FIG. 9 to attach wheels to suitcases that only have handles but no wheels. Since the wheeling frame of FIG. 9 can be made of very strong, virtually unbreakable materials, it can be simply attached to any suitcase that does not have rolling wheels but only a handle. This will assure that suitcases will last longer as their weakest component, the wheels, are not present and the suitcase does not need to have an especially strong bottom to support wheels. This frame can be easily moved from suitcase to suitcase, so it suffices for an individual or family to have fewer frames than suitcases.

Figure 10:
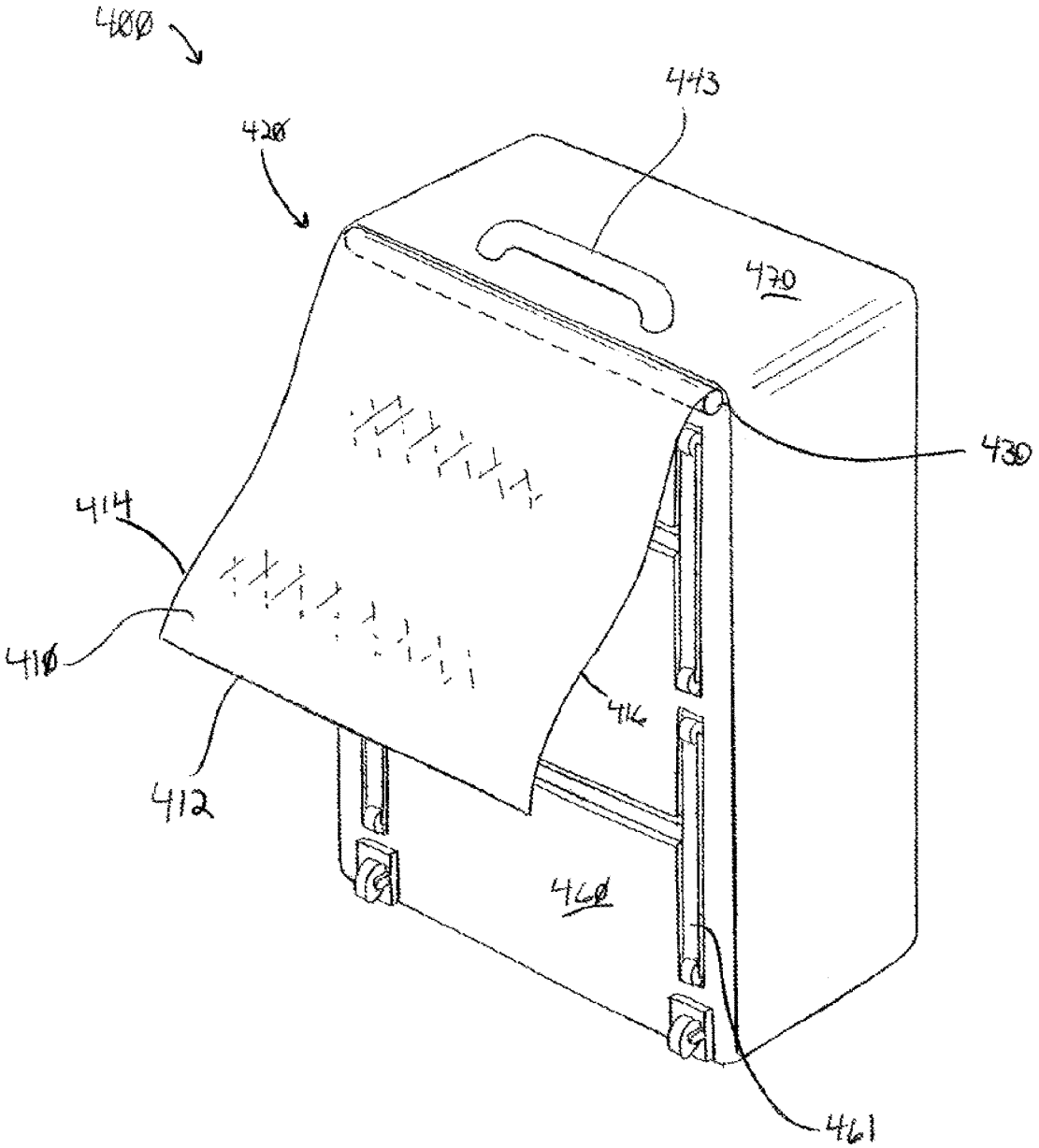
FIG. 10 is a perspective view of a suitcase, illustrating structures on and extending from the suitcase, particularly a protective cover, according to yet another embodiment of the present disclosure.

Referring now to FIG. 10, any of the foregoing embodiments can include as a feature a retractable and/or stowable cover 410 associated with the suitcase, generally 400. The cover 400 is preferably flexible, and more preferably durable, for example a ballistic nylon fabric. When the suitcase 400 is no longer to be rolled by the user, for example where it is checked as baggage or shipped as freight to be handled by a common carrier, the support legs 461 would be placed in a stowed position adjacent the suitcase 400.

The cover 410 would be extended from its storage location 420, which may be a pouch or more preferably a chamber having the cover 410 wound about a spring-loaded retracting cylinder 430. The storage location may be at a back surface 460 of suitcase 400, or top surface 470, in which case the cover 410 would encompass a retractable handle 443 when deployed. In the cart embodiments previously discussed, the cover may be stored on or in, for example, one of the lateral or top frame members, adjacent to the suitcase, and perform the same function.

Once extended, the cover 410 is of a size and shape to cover the back surface 460 (and optionally at least part of top surface 470) of the suitcase 400. Cover 410 is secured in its deployed position to the suitcase 400 along at least one distal edge 412 of the cover 410, but preferably also along lateral edges 414, 416 of the cover 410. The cover 410 may be secured, for example, by VELCRO® (generically, hook and loop) fastener, or by a zipper, or other such equivalents known in the art. Secured to the suitcase 400, the cover 410 protects the undercarriage of the suitcase 400 during transit.

Figure 11:
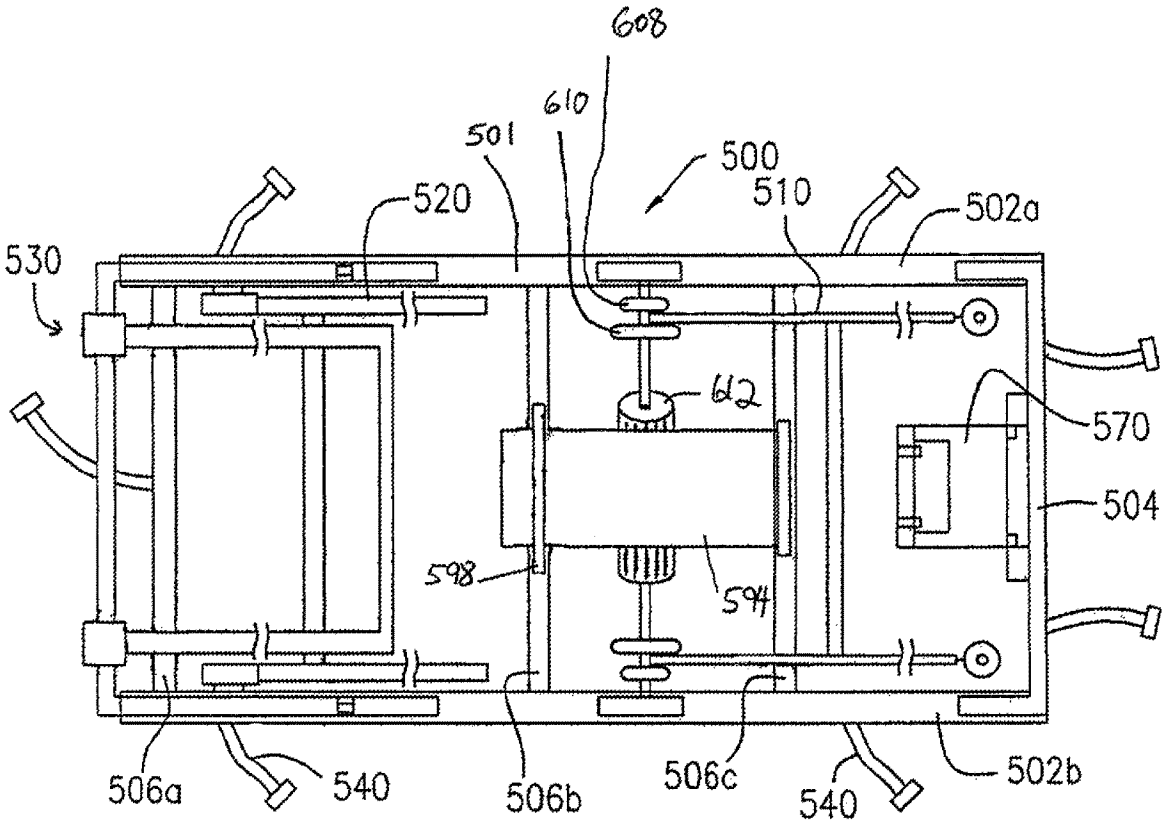
FIG. 11 is a plan view of a wheeling frame attachable to a suitcase similar to the frame illustrated in FIG. 7, according to a further embodiment of the present disclosure.
Figure 11A:
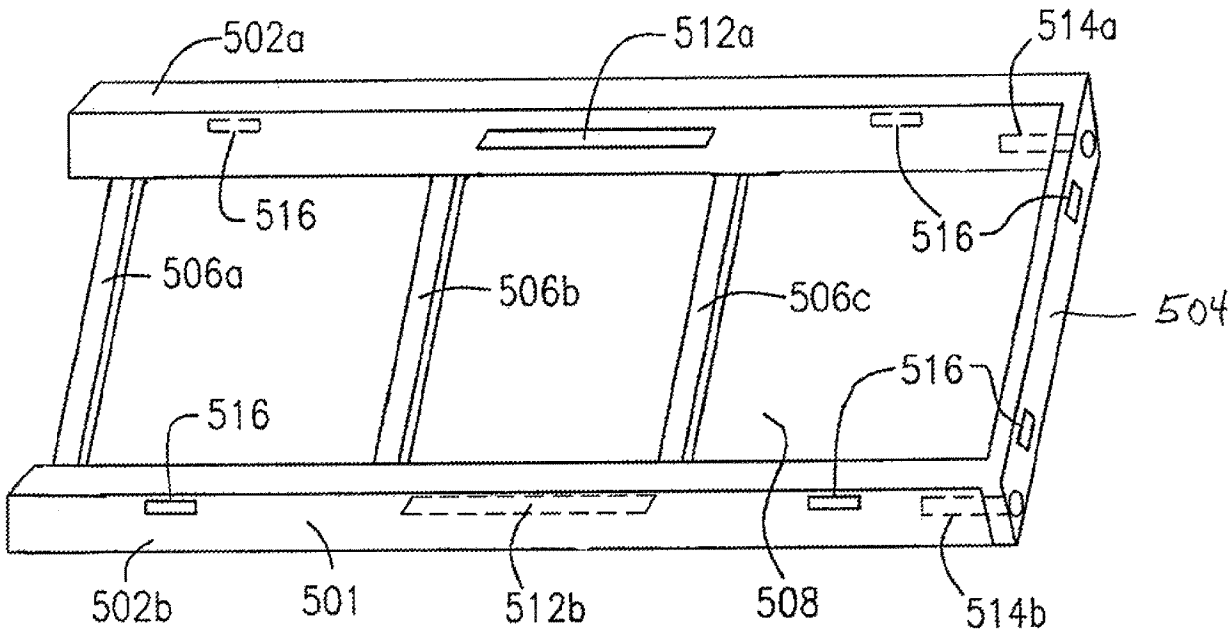
FIG. 11*a* shows details of the frame assembly of the embodiment of FIG. 11.
Figure 11B:
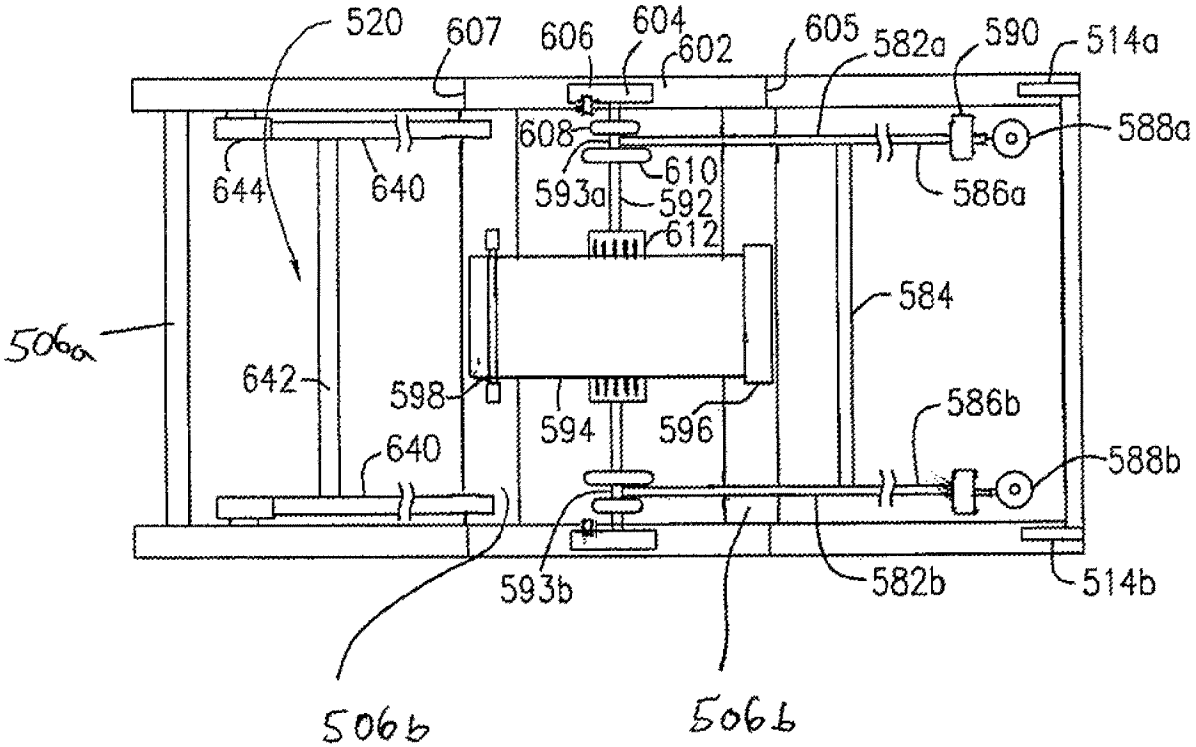
FIG. 11*b* shows the leaning and rear wheel assemblies of the wheeling frame of FIG. 11.
Figure 11C:
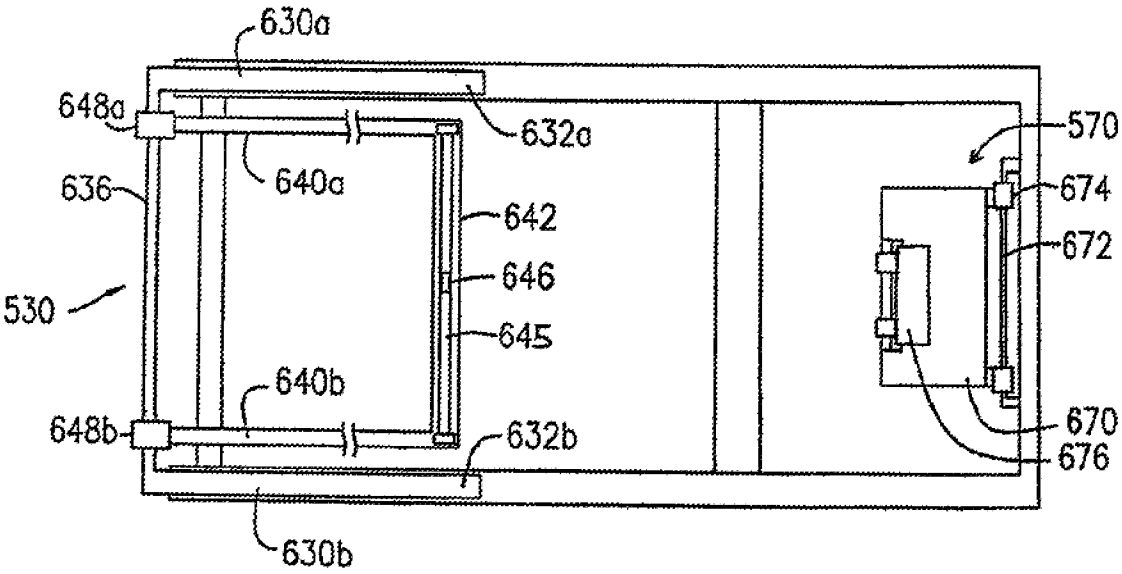
FIG. 11*c* shows the handle and ledge assemblies of the wheeling frame of FIG. 11.
Figure 11D:
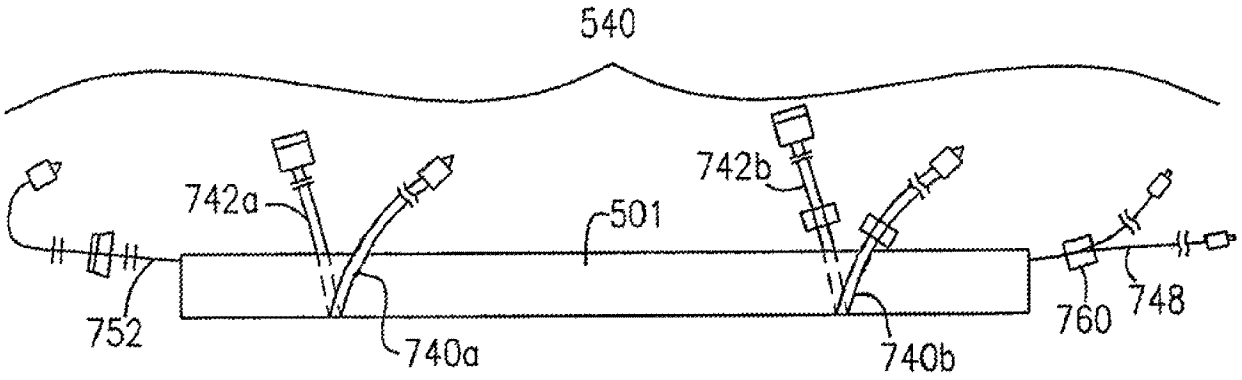
FIG. 11*d* shows the strap arrangement of the wheeling frame of FIG. 11.
Figure 11E:
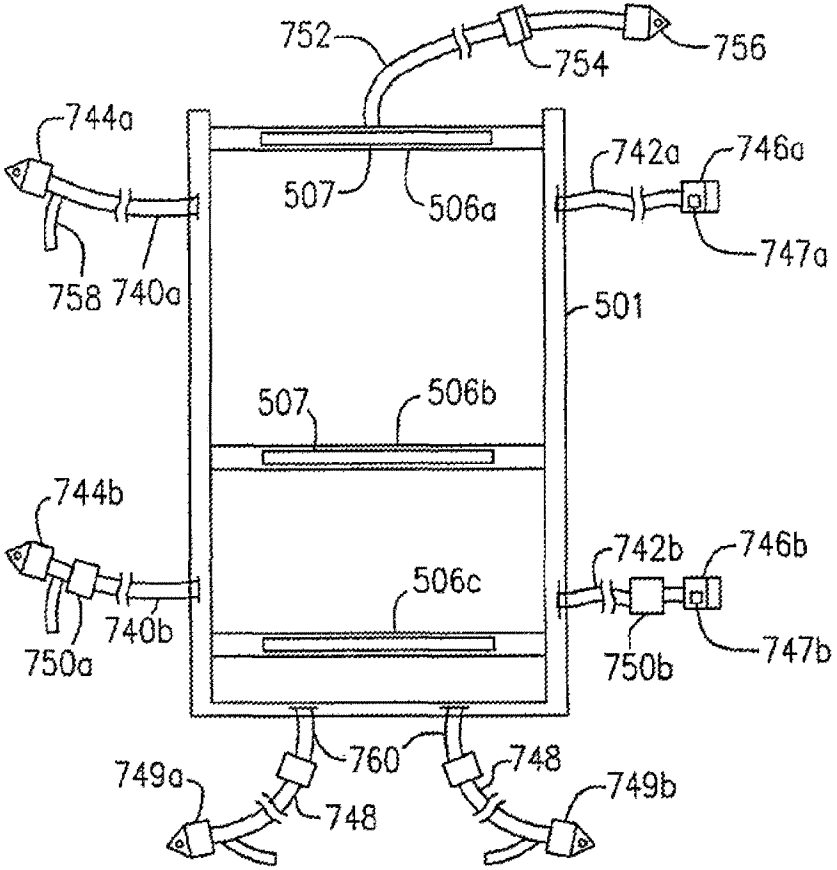
FIG. 11*e* shows the rear of the frame of FIG. 11*a*.
Figure 11F:
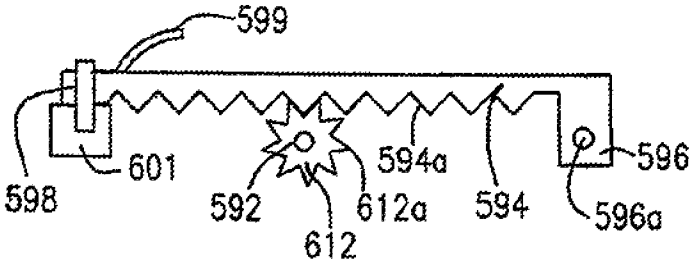
FIG. 11*f* shows a mechanism for maintaining a pivoting position of the leaning wheel assembly.
Figure 11G:
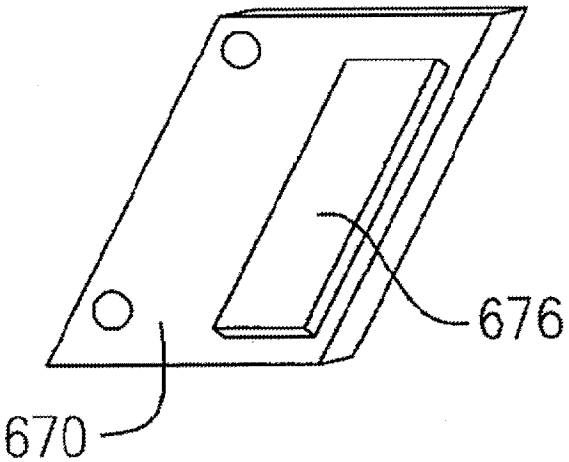
FIG. 11*h* shows details of the ledge assembly.
FIGS. 11*i*, 11*j*, 11*k*, 11*l*, 11*m*, 11*n* and 11*o* show mechanisms associated with the leaning wheel assembly.
FIGS. 11*p*, 11*q* and 11*r* illustrate member extension techniques.
Figure 11H:
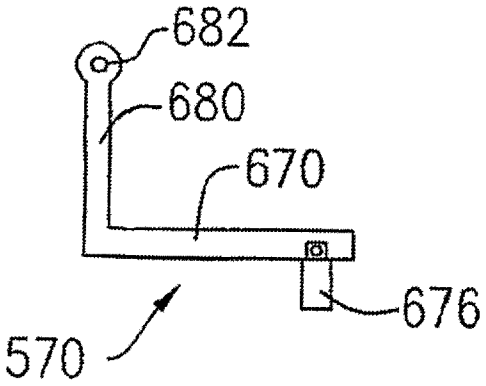
Figure 11I:
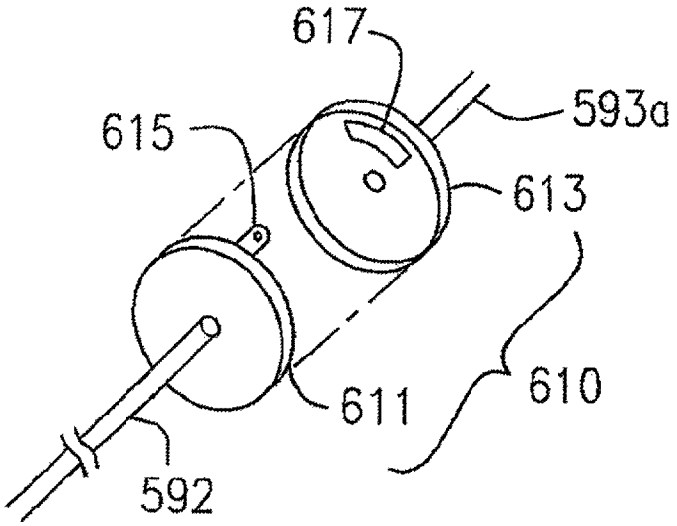
Figure 11J:
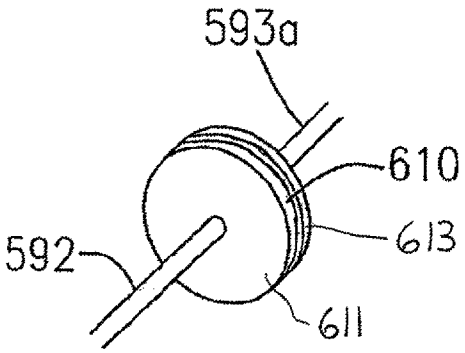
Figure 11K:
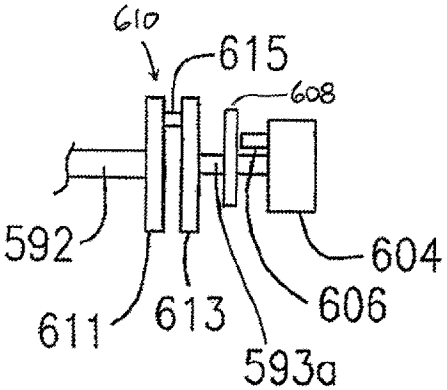
Figure 111:
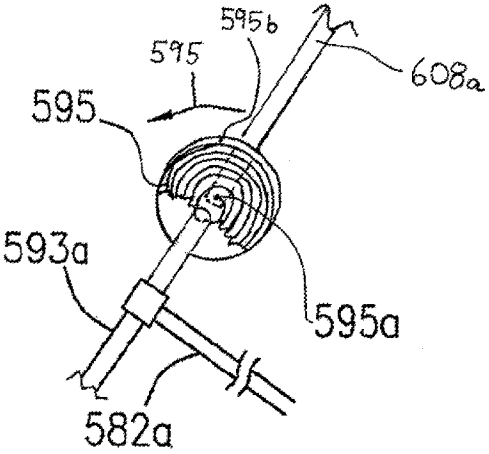
Figure 11M:
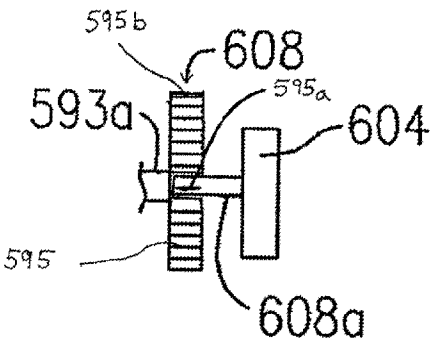
Figure 11N:
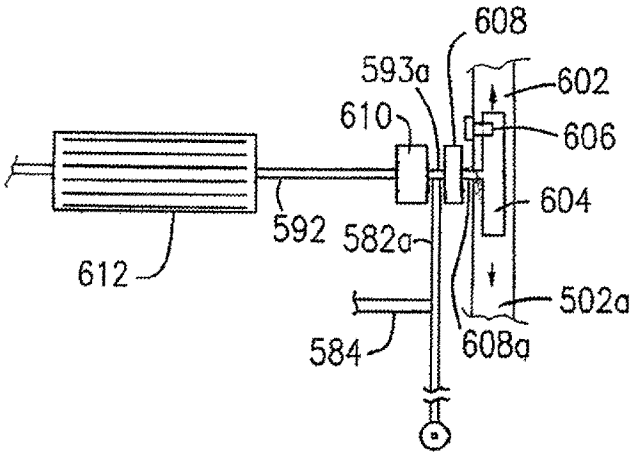
Figure 11O:
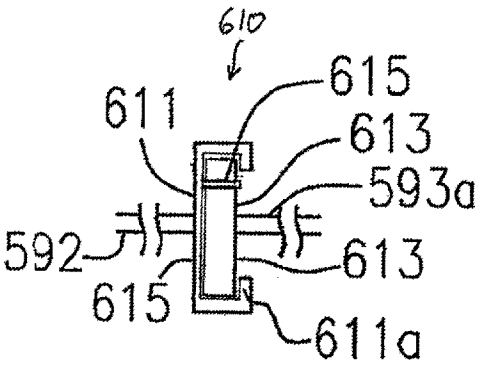
Figure 11P:
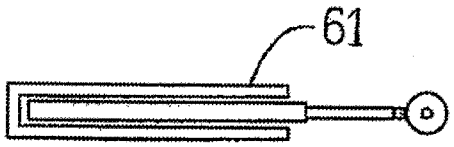
Figure 11Q:
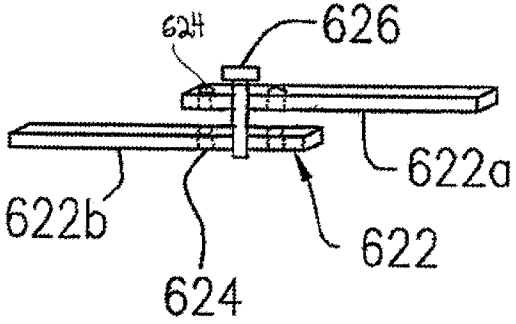
Figure 11R:
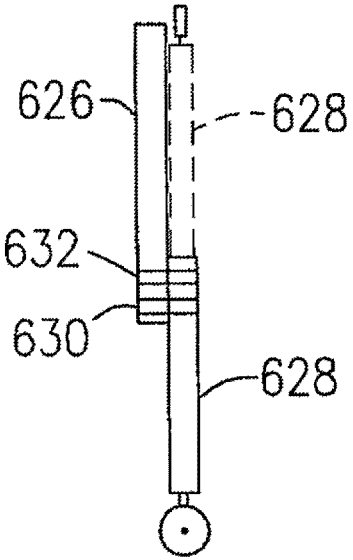
Figure 12:
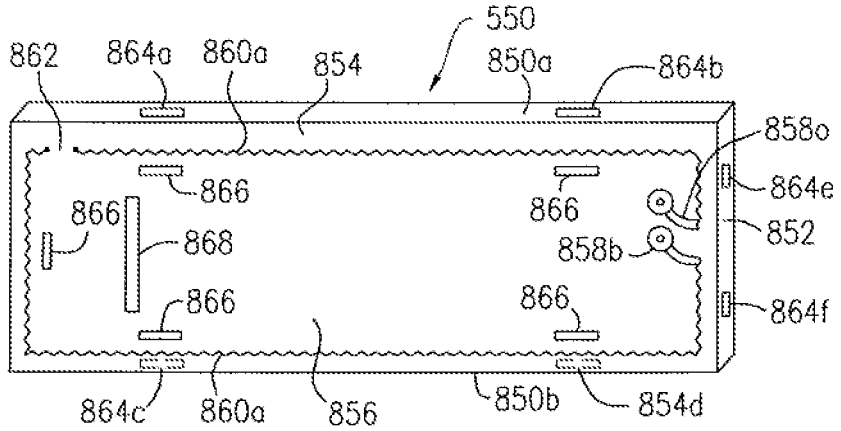
FIG. 12 shows perspectively a bag, similar to a garment bag of FIG. 11.

With reference to FIGS. 11 and 11*a* 11*r*, as well as FIGS. 12*s* and 12*a* 12*e*, a further embodiment of a wheeling frame (shown in the figures diagrammatically) is described below, noting initially as follows.

First and foremost, the wheeling frame 500 of FIG. 11 is not to be perceived to be and is not a handtruck for luggage.

It does not have and is not normally intended to have any load-bearing wheels, in the manner of a handtruck. It is constructed to be a very compact steel or even plastic frame which is to be strapped to a suitcase 560 (FIG. 13*a*), which suitcase 560 has its own load carrying wheels 562, and is intended to be loadable into the cargo hold of an airplane or a bus with the frame 500 still attached to the suitcase and appearing to be an integral part of the suitcase.

The frame 500 is generally elongate, with a length and width closely matched to larger type suitcases measuring on the order of 30 inches long and 20 inches wide (and 11-12 inches thick). Therefore, the frame 500 preferably has a length and width in a range of about 24-28 inches and 16-17 inches, respectively, or, in other words, one or two inches shorter than the respective length and width of the suitcase. The thickness of the wheeling frame should be extremely thin; preferably from ¾ inch to no more than 2 inches in thickness, in order to add very little to the overall suitcase/frame dimensions.

The primary purpose of the wheeling frame is to allow the suitcase to lean backward, while it is being pushed or pulled in use, to avoid any weight of the contents of the suitcase being borne by the traveller who pushes the heavy suitcase. As will be described, a wheeling leg assembly 510 allows the pivoting angle, the length and the base position of the leaning legs 582*a*, 582*b* (FIG. 13*a*) to be adjusted.

The frame optionally includes rear legs assembly 520 (FIG. 13*b*) intended to be used with the leaning legs 582 to allow the frame 500 to be used in a table mode, in which the suitcase 560 is supported on the frame table to enable its contents to be packed or unpacked with greater ease, particularly for those who are physically disadvantaged, aged or unable to bend down to handle the contents of a suitcase lying on the ground.

A further feature of the wheeling frame is a handle assembly 530 (FIG. 13*a*) that allows the height and the distance of the holding position of the frame to be easily adjusted for maximum comfort, by adjusting the holding height to the personal preferences of the users thereof. In accordance with one embodiment, the handle system 530 may be used to realize the table mode of the invention, by being manipulated to function as the rear legs of the frame, dispensing with the need to provide the rear legs assembly, as shown in FIG. 13*f*.

Another important feature of the wheeling frame comprises providing it in its own concealing bag (FIG. 12*e*), so that when the bag 550 is closed the wheeling frame appears to be, for all intents and purposes, an integral part of the suitcase itself.

Referring to FIG. 11, the frame 501 of the wheeling assembly 500 comprises long members 502*a*, 502*b* and at least one width member 504 joined to one end of the long members 502. A plurality of flat cross members 506*a*, 506*b*, 506*c* rigidify the wheeling frame 501 and define within the frame a space 508 used for holding, supporting and stowing the various assemblies, such as the wheeling assembly, the rear leg assembly and the handle assembly, entirely within the space 508.

Figure 14A:
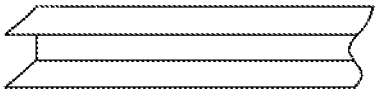
FIGS. 14*a*, 14*b* and 14*c* show different cross-sectional shapes for the frame pieces and a varient implementation for the handle system thereof.
Figure 14B:
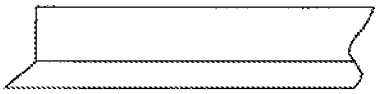
Figure 14C:
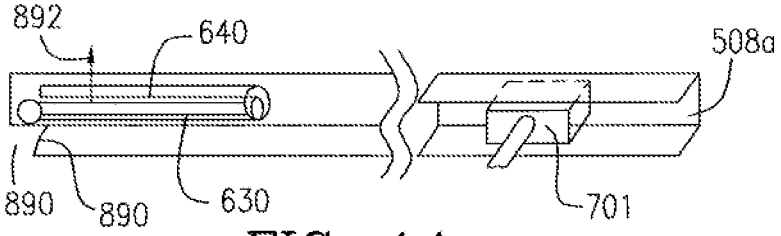

In FIG. 11*a*, the long 502*a*, 502*b* and short 504 frame members are shown to have rectangular cross sections and an interior space in which certain components of the assemblies can be located. However, the cross section can be L-shaped or U-shaped with the U-shape open to the interior space 508 and various structures stored within the U-shape of the members (FIGS. 14*a*, 14*b* and 14*c*).

Preferably, the cross members 506*a*, 506*b* and 506*c* are so attached to the long members 502*a*, 502*b* that the bottom of the frame is flat and smooth, so that when it is rested against the rear of a suitcase, it lies flat thereagainst, as shown in FIG. 11*e*. The friction strips aid to prevent sliding between the frame and the suitcase.

FIG. 11 shows that within the space 508 of the frame 501 are arranged the wheeling assembly 510, the rear wheel assembly 520, the handle assembly 530, and ledge assembly 570. Attached to the frame 501 is a strap arrangement 540 which includes various straps (to be described) that are attached to the long members, the short member and to the cross member 506*a*.

As seen in FIG. 11*a*, the outer wall members of the frame may have slits 516 at which one end of the straps 540 (to be described) may be anchored to the frame. The interior wall of the long frame members have sliding slots 512*a*, 512*b* for anchoring blocks 604 for the wheeling legs assembly 510, as shall be described. The interior receptacles 514*a*, 514*b* can be utilized for attaching load bearing wheels (not shown) to the frame 501, if it is desired to convert the wheeling frame into a luggage handtruck. Alternatively, a ledge system 570 (FIG. 11*a*) for supporting thereon a suitcase can be supported in the receptacles 514*a*, 514*b*.

The leaning wheels assembly 510 comprises a pair of leaning legs 582*a*, 582*b* which are each respectively extendible by extendible legs 586*a*, 586*b*. These legs support respective wheels 588*a*, 588*b*, each of which is designed to be disc-shaped with a thickness of about half an inch and a diameter of preferably about one to two inches, and designed to be caster mounted so as to freely wheel within its respective support, so that in the stowed position, the wheels lie flat and are contained entirely within the space 508 of the wheeling frame 501. The legs 582*a*, 582*b* are joined and strengthened by cross member 584.

As shown in FIG. 11*b*, the leaning legs 582 are pivotable outside of the frame 501 by a pivoting mechanism which comprises the rotatable axis 592, which is coupled via a lost motion member 610 (to be described) to a rotatable pivot axis 593*a*, 593*b* to which the legs 582*a*, 582*b* are respectively attached. The axes 593*a*, 593*b* are coupled via a biasing spring 608 to the anchoring block 604 provided at each end of the frame 501. The pivot axis supporting block(s) 604 are slidable within space(s) 602 in the long frame members 502*a*, 502*b* (FIG. 11), which space 602 preferably extends from about the 11 inches to the 20 inches position on the frame, measured from the right side of the wheeling frame 501 shown in FIG. 11*b* (which frame typically measures 24 inches to 28 inches). The position of the block 604 can be secured with spring biased pin(s) 606. A similar structure is provided at the opposing frame side of the pivots 592/593*a*, 593*b*.

The pivot angle adjusting assembly 594 (FIGS. 11*b*, 11*f*) (to be described) interacts with a grooved, gear section 612 on the axis 592 and serves to hold the angular position of the leg assembly 582*a*, 582*b* (as shall be described).

Referring now to FIG. 11*n*, note the illustrated sliding block 604 which is slidable back and forth within the interior space 602 and the position of which is fixable by the pin 606 or any other position holding mechanism. An extension 608*a* of the slidable block 604 protrudes from the frame-piece 502*a* and is attached to the bias spring 608, which is disc-shaped. The disc-shaped bias spring 608 has on its post side the axis 593*a* which extends at its other end to the lost motion mechanism 610. The leg 582*a* is connected to the axis 593*a*.

With reference to FIGS. 11*l* and 11*m*, the spring biased disc 608 is rotatable upon the block extension 608*a* as shown in FIG. 11*m*. Internally, the spring bias disc 608 has a spiral, tightly wound spring leaf 595, one end of which (595*b*), is attached to the outer peripheral surface of the spring bias 608 and the opposite end (595*a*), which is attached to the axis 608*a*, which extends within the interior space thereof.

Owing to spring leaf 595, the spring member 608 naturally biases the axis 593*a* to rotate counterclockwise in FIG. 11*l*, as shown by the arrow 609. Because the legs 582*a*, 582*b* are affixed at the axis 593*a*, the action of the bias spring 608 (at the two opposed side of the frame) constantly urge the legs to rotate out of the frame 501, and if not restrained, would turn the legs by at least 180° to the opposite direction. In the normal position, however, locks 590 provides at opposed ends of the leg extension 586*a* (FIG. 11*b*), hold the legs in the stowed position. The legs 586*a*, 586*b* snap into and are held within a groove or the like in the holding blocks 590.

Reverting back to FIG. 11*n*, the counterclockwise rotational force exerted by the spring bias disc 608 is naturally imparted to the lost motion mechanism 610 and, in turn, to the axis 592. However, the tendency to rotate counterclockwise is restrained, owing to the anti-rotation gear 612 being engaged with the angle position holder 594 (FIG. 11*f*). This serrated bar 594 with its own serrated teeth 594*a* engage with the corresponding teeth of the gear 612*a* which normally prevents rotation of the axis 592. To release the holding force, a user would grasp the handle 599 (FIG. 11*f*) and lift the holder 594, allowing it to move upward at the lefthand side, by pivoting around the pivot point 596*a* shown in the block 596 (at the righthand side), against the holding force of the resilient band 598, which is anchored in the block 601. Lifting the holder 594 allows the legs 502*a*, 502*b* to pivot to a rotational position desired by the user, for the various purposes of the wheeling frame, as shall be described.

It should be noted that the disc 608 can be built-in into the block 604.

Referring now to FIGS. 11*i*, 11*j* and 11*o*, note that the lost motion mechanism 610 actually comprises a pair of cup-shaped discs 611 and 613, which are centrally mounted to the axis 592 on the exterior thereof. The disc 611 receives within the opposing cup-shaped disc 613 and has outer lips 611*a* which prevent the disc inside 613 from being disengaged, while allowing its rotation therein about its own axis 593*a*, as shown in FIG. 11*o*. The smaller diameter interior disc 613 has a slot 617, extending over an angular range of about 5° to 55°. A pin 615, which is formed to slide inside the slot 617, projects from the interior of the opposing disc 611, as shown in FIGS. 11*i* and 11*o* and as is diagrammatically illustrated in FIG. 11*k*. As the cup portion 613 is biased to rotate counterclockwise, it imparts that counterclockwise rotation bias to the opposing cup 611 via the pin 615, which engages the rightside wall of the slot 617. Thus, in a hypothetical orientation where the legs 582*a*, 582*b* extend at 90° to the plane of the wheeling frame 501, and are fixed in that position by the mechanism shown in FIG. 11*f*, it is still possible to forcefully rotate the legs downward (clockwise) by a certain angular range which is determined by the angular range of the slot 617. The purpose thereof will become apparent further on.

Figure 13A:
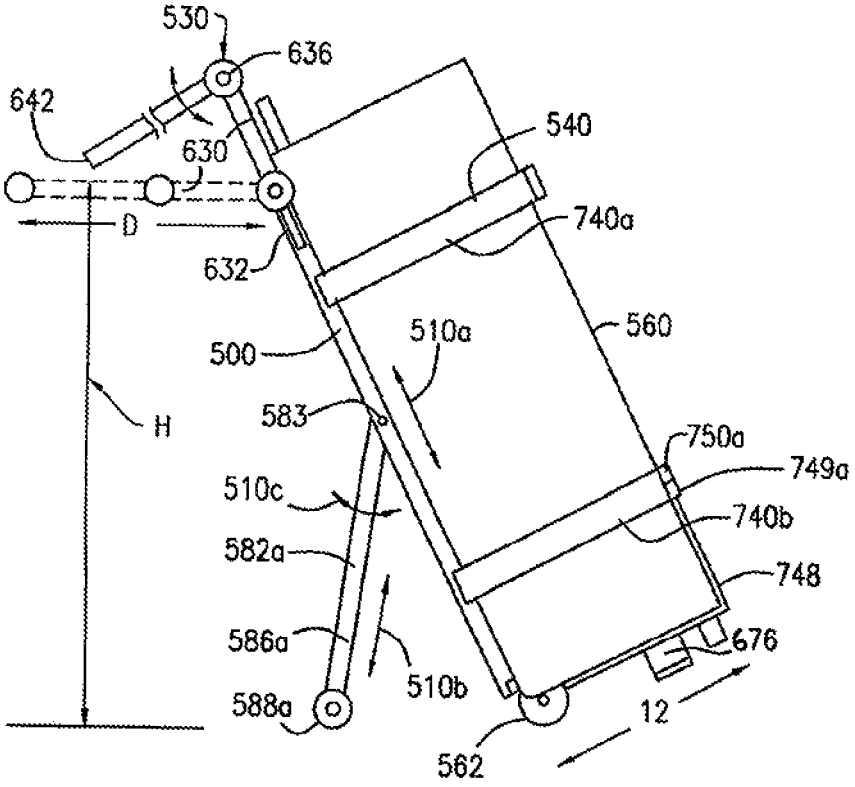
FIG. 13*a* shows the wheeling frame of FIG. 11 in use, while secured to a suitcase.
Figure 13B:
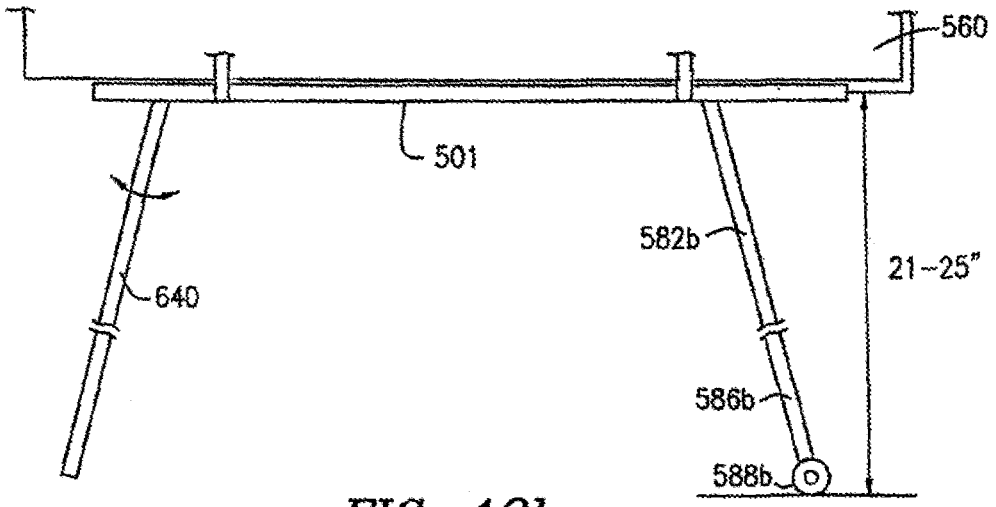
FIG. 13*b* shows a table position of the wheeling frame.
Figure 13D:
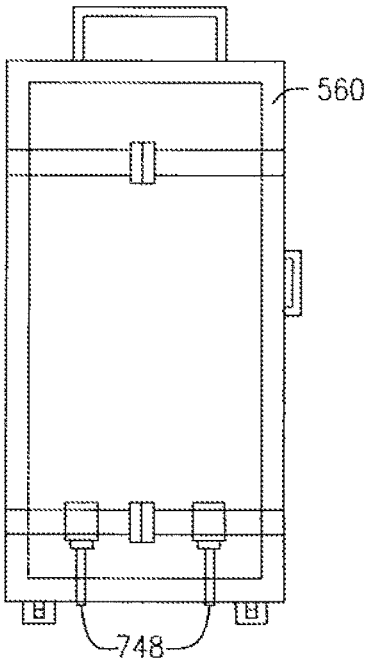
FIGS. 13*c* and 13*d* further illustrate the wheeling frame of FIG. 11 in use, attached to a suitcase.
Figure 13C:
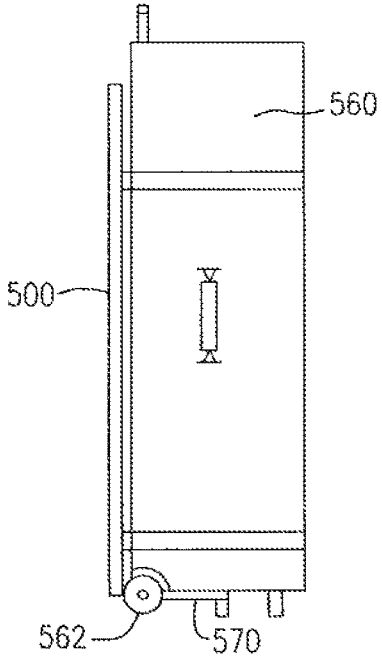

As shown in FIG. 13*a*, when the wheeling frame 500 is attached via its strap system 540 to the suitcase 560, the suitcase can be either pushed along or pulled with considerable versatility and adjustability, owing to at least the following features. The wheeling frame is basically entirely flat and rests snugly against the rear of the suitcase 560. The position of the wheeling frame 500 can be easily adjusted up or down relative to the rear of the suitcase. There are no wheels at the bottom of the frame to interfere. The suitcase can be tightly attached via the horizontal straps 540*a* and 540*b* and will not slide, including an account of the high friction pads on the crossbars 506*a*, 506*b* and 506*c*, as shown in FIG. 11*e*.

Suitcases come in different sizes and they can be packed in different manners. Mostly, the center of mass is lower down, since the heavier items are typically packed at the bottom of the suitcase. But the leaning wheel assembly 510 is sufficiently versatile that is can easily accommodate any suitcase within several ranges of sizes, thicknesses and weight distributions. This ensues from the fact that the pivot point 583 (FIG. 13*a*) of the legs 502 is adjustable inside the frame along the arrows 510*a*. The length of the legs is adjustable along the arrows 510*b*. Lastly, the angle of the legs is adjustable along the arrows 510*c*, with the wheels able to be pushed a certain degree inwardly, as previously described, for the purpose of staircase lifting of the suitcase, as described below by reference FIG. 13*e*.

Figure 13E:
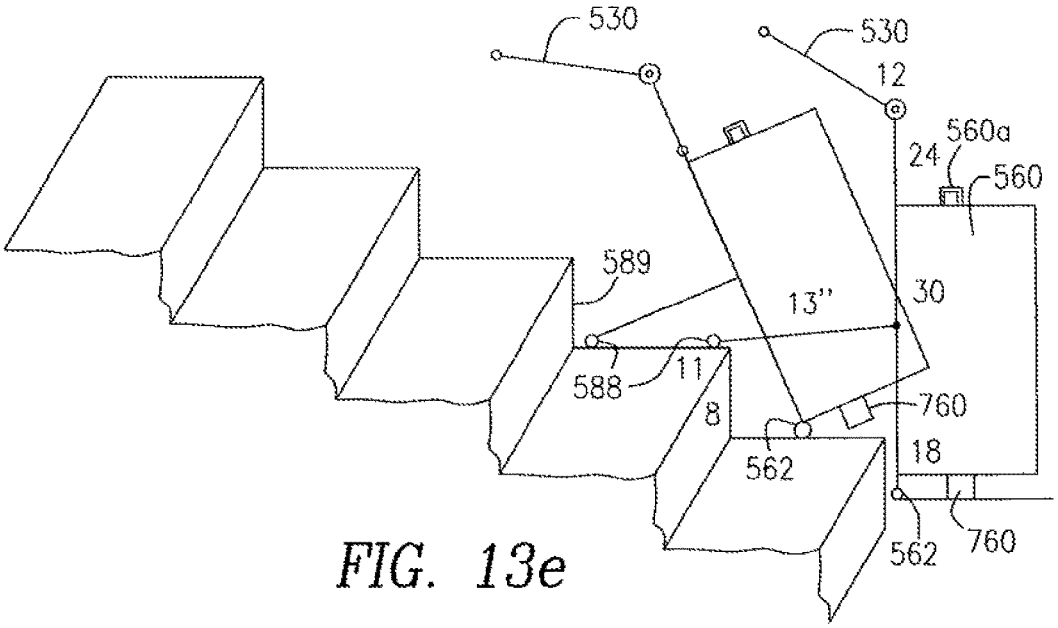
FIG. 13*e* illustrates the wheeling frame of FIG. 11 in use in a stair climbing mode.
Figure 13F:
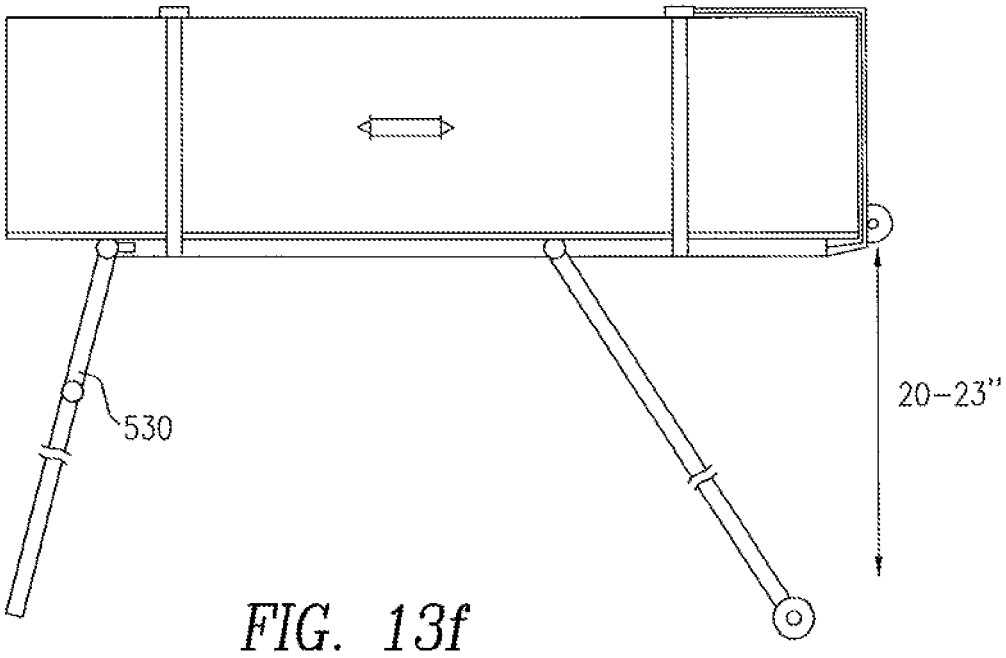
FIG. 13*f* illustrates a table mode for the wheeling frame in which the handle assembly serves as one of the supporting legs.

In FIG. 13*e*, the leaning wheels are used to easily walk a suitcase up steps, even with a heavy suitcase weighing 50-60 lbs. This can be done by a relatively feeble, elderly person or a physically weak person. Initially, the suitcase 560 is at the bottom landing with its own wheels 562 on the landing. The orientation and length of the leaning legs 502 are then so positioned and their length so extended, that their wheels 588 just reach the second step, slipping over the first step. The handle system 520 is so designed that it allows the suitcase to be pivoted about the wheel 588, so that, as the suitcase 560 is being pivoted, it also rolls with the wheel 588 moving toward the vertical wall 589 of the third step. At the same time, either the frame or the suitcase handle is utilized to allow the suitcase itself to reach and then travel on the first step, while the wheels 588 roll on the third step. When the wheels 588 are on the second step, touching the vertical wall 589, they normally would prevent leaning the suitcase back, owing to the fact that typical stairs have a flat of about 11 inches to 12 inches and a "rise" of about 7 inches to 8 inches would then "push back" the suitcase, possibly falling back. However, the lost motion mechanism 610 (FIGS. 11*i*. 11*h*) now comes into play, by allowing the legs 582 to yield and bend inwardly as the suitcase 560 is rotated clockwise to a more upright position. But as soon as the wheels 588 clear the vertical wall 589, they will spring back and come to rest on the flat of the third step, allowing the suitcase 560 to roll on its own wheels 562 on the first step, and so on repeatedly. Thus, the suitcase 560 can be literally "wheeled" up the steps, without ever lifting the entire weight of the suitcase in the air, which would be impossible for many people when the suitcase weighs 50-60 lbs. In other words, the mechanical advantage obtained from the long handles allows forces smaller than the suitcase weight to be used to propel the suitcase up a staircase. The method works in reverse going down steps. The user stands above or alongside the suitcase, not below. And since the handle system can be extended two to four feet above the suitcase, the user does not have to stoop down while walking the suitcase downstairs, which greatly increases ease of use and safety.

In FIG. 13*e*, for typical steps with a flat of about 11 inches to 12 inches and a rise of about 7 inches to 8 inches, the position of the leaning wheels might be fixed at approximately 18 inches up the suitcase with the leg extension being about 13 inches, so that the span would be just right for typical steps. However, if the steps have a different pitch or a different ratio between the flat and the vertical surfaces of the steps, the wheeling frame of the present invention is sufficiently versatile to accommodate any step pitch and orientation. One of the important aspects here is the ability to walk the suitcase up the steps owing to the pivoting handle system of the wheeling frame which will be described further on.

Referring now to FIG. 11*b*, the rear legs assembly 520 comprises a pair of extendible legs 640 connected to one another by a crossbar 642 for structural strength and stability and each of these legs is mounted in a pivoting block 644 which is anchored to the frame 501. These legs can be rotated counterclockwise as shown in FIG. 13*b*, preferably to an angular position slightly greater than 90° relative to the plane of the frame 101, as shown in FIG. 13*b*. In operation, it is intended that the wheeling legs 582 will be extended and rotated to an angle smaller than 90°, at the right side of the frame, while the legs 640 at the rear are rotated to an angle greater than 90°, to hold the suitcase 560 very stably in the table mode at a height of approximately 20 inches to 25 inches above ground. This is convenient enough for a relatively feeble or weak person to both pack or unpack the suitcase without having to be concerned with bending too low to the ground. When the suitcase has been packed, and the straps tightened around it, it is not unduly difficult to tip the suitcase over onto the leaning legs to bring it to a leaning and then vertical position. Preferably, the crossbar 642 lies deep in the space, so that it does not interfere with the ability to place the handle system in the space between the legs 640, as will be described. Note that the rear legs assembly may be designed to rotate (pivot) by angle as high as 180° or more, to also serve as a handle system for the wheeling frame.

Referring to FIG. 11*c*, the handle assembly 530 comprises either telescoping or sliding arms 630*a*, 630*b* which slide within the frame 501*b* and which protrude out of the frame and are joined by an intermediate cross handle 636. In FIG. 11*c* are also shown the blocks 648*a* and 648*b* through which a bar 636 passes. As shown in FIG. 13*a*, when the handle arms 630*a*, 630*b* are pulled out of the frame, they can be further pivoted relative to the frame, as shown in dotted lines, relative to the arms 630. The pivot direction can be away or toward (over) the frame and the suitcase. Mounted on the connecting handle 636 is another pivotable handle with extendible arms 640*a*, 640*b* (throughout these figures, the "extendible" feature is denoted by the broken vertical/parallel lines), which arms are joined by the cross member 642. Inside the cross member 642 is a further handle 645, which can be laterally pulled to the right or to the left via the button 646, which rides in a slot in the cross member 642. Referring to FIG. 11*c*, details of the ledge assembly 570 diagrammatically illustrated in FIG. 11 includes the following. Element 670 is a support shelf, described in one form thereof previously, relative to the illustration of FIG. 7 and the support shelves 285*a* and 285*b*. Like the support shelves 285, the support shelf 670 can fold into the frame by rotating on the pivot support 672, which it engages at the blocks 674. Also, the element 676 is a ledge step which pivots relative to the plane of the support shelf 670.

In use, when the handle system 530 comprising the elements 640*a*, 640*b* and 642 is pivoted out the plane of the frame, as shown in FIG. 13*a*, the handle can be positioned so that the height (H) and distance (D) from the suitcase can be easily adjusted by the user. A great degree of versatility is thus obtained either for normal pushing or pulling the suitcase (or any other load attached to the frame), or for "walking" the suitcase up or down a staircase. In particular, note the mechanical leverage that these handles provide relative to the position of the wheels 588*a* in FIG. 13*a*. Also, for "walking" the suitcase downstairs, the handle system would be bent (pivoted) in a direction generally vertically up toward the user, while the plane of the frame is generally parallel to the inclination of the staircase. This avoids having to bend down while walking the suitcase down the stairs without using the leaning legs.

The ability to draw out from the handle the interiorly slidable bar 644 allows one to walk alongside the suitcase, rather than having to stand directly behind it when it is being pulled. It also assists in positioning oneself on a staircase when desiring to push the frame down to pivot the suitcase up while obtaining the full advantage of the mechanical moment while doing so.

The strap assembly 540 of the present invention is illustrated in FIGS. 11*d* and 11*e*. In FIG. 11*e*, the frame 501 is shown with lefthand side, upper and lower belts or straps 740*a*, 740*b* attached to the frame, and each strap having its respective male buckle 744*a*, 744*b*. At the righthand side, upper and lower straps 742*a*, 742*b* are each attached to its respective female strap buckle 746*a*, 746*b*. The upper and lower straps are wrapped around the suitcase 560, as previously described, and the strap pulls 758 are firmly grasped and pulled, to tighten and very securely fasten frame 501 to the suitcase 560. Preferably, the connection points of the straps to the frame are high near the edge, at the slots 516 (FIG. 11*a*), so that the straps, when tightened, tend to "bury" the frame into the soft fabric or surface of the suitcase to reduce the "footprint" of the wheeling frame 500 on the suitcase. Preferably, the release buttons 747*a*, 747*b* on the frame buckles 746*a*, 746*b*, respectively, face down, toward the fabric of the suitcase, to prevent accidental release thereof when handled by airline luggage handlers. Thus, one must insert her finger under the straps to release them.

For added holding power, the bottom lefthand and righthand straps 748, each with its respective male buckle 749*a*, 749*b*, are designed to be guided between the wheels 562 of the suitcase and back up to the front so that each may be plugged into its assigned female plugs 750*a*, 750*b* on the main straps. See FIG. 13*a*. The blocks 760 can be relatively positioned on the respective bottom straps 748, their purpose being, as seen in FIGS. 13*a* and 13*e*, to prevent the suitcase from tipping over backwards down the steps (counterclockwise) when the width of the suitcase is wider than the "flats" of the staircase steps.

Lastly, the upper strap 752, which is intended to be thrown over a suitcase to the front thereof, has a female plug 754 and further on down, a male plug which can be threaded into one another, while grasping the handle of another piece of luggage or a lady's handbag or hand luggage which is to be carried atop the main suitcase 560. In general, the buckles may have a covering sleeve over them to prevent accidental (or mischievous) disconnecting of the frame 501 from the suitcase 560.

Relative to the previously described ledge assembly 570, FIG. 11*h* shows an elongate pair of pins 680 which culminate in a catch 682. Thus, if desired, the ledge assembly can be mechanically fastened to the wheeling frame 501 via the holes 514*a*, 514*b* (FIG. 11*a*) to secure the support shelve 670 to the frame. Parenthetically, it should be noted that although not contemplated by the present inventors for the main purpose of the frame 500, instead of the ledge assembly 570, a pair of removable wheels may be also connected to the frame if the frame is to be used to serve as a handtruck or the like, rather than as a wheeling assisting device or mechanism as described above.

It is important for the purposes of the commercial success of the wheeling frame that it be permitted to remain attached to the suitcase 560, while the suitcase is being processed by luggage handlers at airports or railroad stations and the like. For this purpose, the entire wheeling frame and its wheels and legs assemblies, as well as its handle system are all preferably substantially encased in what is referred to below as the wheeling frame bag 550. In a manner somewhat similar to a conventional garment bag, the instant cover comprises (as shown in FIGS. 12, 12*a* and 12*c*), side panels 850*a*, 850*b*, a bottom side panel 852, a circumscribing, front section 854, which surrounds a zipper fastener 860*a* and 860*b*, along which respective zipper closures 858*a*, 858*b* which can be moved to an end location 862, to allow lifting the front panel 856 and so expose the inside of the wheeling frame within the bag 550.

Figure 12A:
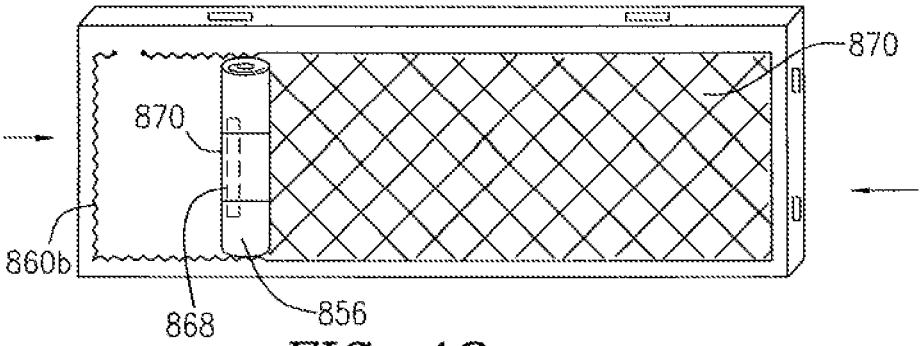
FIG. 12*a* shows the rear of the wheeling frame bag.
Figure 12B:
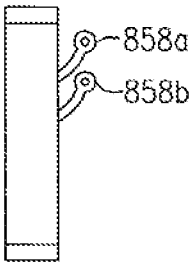
FIGS. 12*b* and 12*c* show end views of the wheeling frame bag.
Figure 12C:
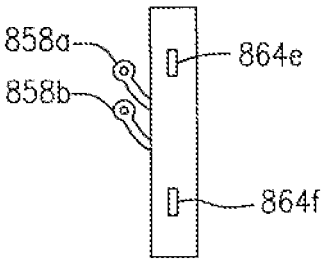

The front panel 856 can be rolled up, as shown in FIG. 12*a*, whereby a hook and loop (Velcro®) strip 868 is brought into engagement with a corresponding section 868 (FIG. 12*a*) to roll up in a manner which enables the panel 856 to be rolled up and held in place while the wheeling frame is used. Alternatively, the openable panel 856 may be rolled in a direction opposite to that shown in FIG. 12*a*, and then tucked underneath the remaining section of the panel 856. Or, the entire zipper line may be opened and the panel folded up (and hooked to the front straps by snaps or the like or clips (not shown)). The view of the wheeling frame bag, as seen along the righthand side arrow in FIG. 12*a*, is shown in FIG. 12*c*, whereas the view from the lefthand side arrow is shown in FIG. 12*b*.

Figure 12D:
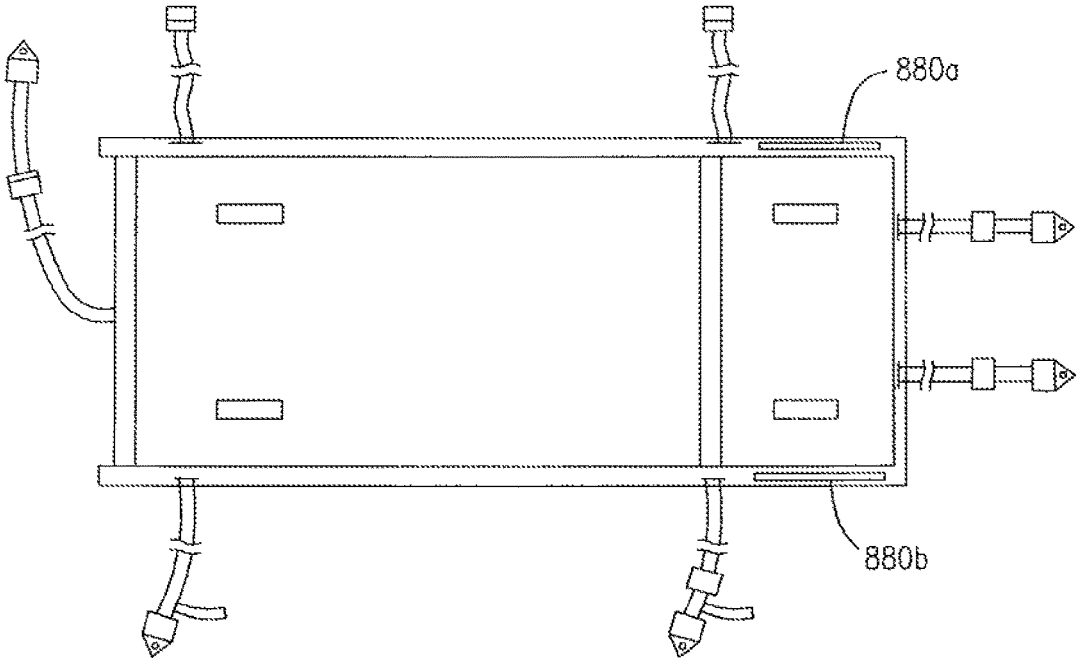
FIGS. 12*d* and 12*e* show further details of the wheeling frame bag.
Figure 12E:
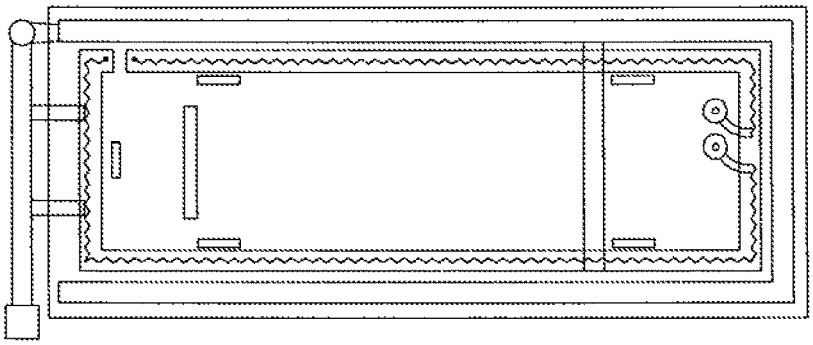

The bag may be closed at its back by fabric, or it may be open. Alternatively, a netting 870 may be provided. The front panel 856 may have slits 866 at various locations thereof, through which the straps 540 of the wheeling frame which may protrude through the provided openings 864*a*, 864*b*, 864*c*, 864*d*, 864*e* and 864*f*, may be tucked into the bag when use of the straps is not needed. A finished look of the bag with the wheeling frame inside may seen in FIGS. 12*d* and 12*e*. Note the straps 540 protruding from the frame. Also, for purposes of climbing the stairs and to avoid the bottom of the frame or the bag material over the frame from scuffing the stairs, an anti-scuff lining or member may be applied at the locations 880*a*, 880*b* in FIG. 12*d*.

Referring to FIGS. 13*b*, 13*c* and 13*d*, note the suitcase 560 which is attached to the wheeling frame (FIG. 13*c*) with the ledge assembly shown in FIG. 13*c* and with the bottom of the suitcase 560 secured with the bottom straps 748 in FIG. 13*b*. In FIG. 13*d*, the anti-tipping blocks 760 are not shown and, indeed, these blocks can be of a type where they can wrapped around a strap in a removable fashion so that they are only there when actually needed for stair climbing or descending purposes. Preferably, the "height" of these blocks orients the suitcase so that it leans toward its load bearing wheels 562, to prevent falling back during stairs climbing.

In the preceding description, the side frame pieces have been described as comprising rectangular, hollow pieces. But as noted, they can be U-shaped, as shown in FIG. 14*a* or L-shaped, as shown in FIG. 14*b*, or other shapes, e.g., circular, oval or plain flat. In fact, the cross-section may change from being L-shaped toward the left of the frame in the figures, with the handle assembly being merely pivotable outside of the frame (rather than having to be pulled out from within the frame, as shown in FIG. 14*c*). Note the undercut ledge 890 which allows the two sections of the arm assembly 630 and 640 (compared to FIG. 11*c*) to be pivoted out of the frame by raising the handles 640 and 630, up in the direction of the arrow 892. The ledge 890*a* is a natural stop and rigidifies the handle and assures that when the handle is pushed down when the suitcase is being pivoted up stairs, it will be rigidly and reliably supported. Similarly, in the various figures, the support structures for the front and rear legs are shown within the interior space 508. However, some of the structures 701 may be provided within the interior space 508*a* of the U-shaped structural members of the frame 501, as shown in FIG. 14*c*.

In summary, therefore, the wheeling frame of the present invention is quite unlike any handtruck or similar device shown in the prior art. It is consciously built to be extremely light, compact and small in size, such as would permit it to be stowed and handled by luggage handlers at airports and the like without those persons demanding its removal. It presents very smooth surfaces which are provided by the wheeling frame bag which can be constructed of smooth and easily slidable material made of fabric or synthetic materials, such as hard plastic and the like. The strap system is position specifically so that when it is tightened, the frame will tend to bury itself into the soft backside of a suitcase, or at least adhere very tightly thereto with great friction. The wheeling frame can be removed and attached to different pieces of luggage and it may be used, if desired, with non-luggage style boxes which don't have their own wheels, by inserting a pair of wheels, recognizing, however, that the strength of the frame is not intended to serve as a handtruck.

The wheeling frame of the present disclosure is not meant to be a permanent attachment to a suitcase, although it may be so positioned in a manner somewhat similar to the wheeling system described in U.S. Pat. No. 6,446,987. However, that wheeling frame does not have any of the adjustable features of the present disclosure. It is designed to handle and fit one particular type of suitcase and is built thereinto. It is described as being attachable to a suitcase. However, the attachment that is described is a permanent attachment. The use of the wheeling frame for raising or lowering a suitcase up or down the stairs is unique in that it is specifically designed with the idea that the person who is using it remains standing more upward on the staircase than the luggage, for obvious safety concerns and is quite different from the stair climber shown in U.S. Pat. No. 4,310,166 to Eicher. The outside zippered surface of the bag, as well as of the frame itself, present a perfectly smooth surface with nothing (or hardly anything) protruding out of the frame or out of the bag. If desired, the openable panel of the bag may have underneath it, various padding that fits between the mechanical or structural pieces to support the top panel rigidly, so that it does not easily push inward and tear.

In the preceding description, reference has been made to members which pivot relative to each other, about their pivoting points. In general, it is considered that such pivoting mechanisms are quite familiar to those skilled in the art and do not require specific description. They may consist of a racheting mechanism, where two members pivot relative to one another. Alternatively, they may comprise parallel discs with spring loaded pins and corresponding pin holes which interact with one another to fix the relative angular positions of the discs, to which the members are coupled. Many other implementations are well known to those skilled in the art.

Throughout the specification, reference has been made to legs or arms and the like which are "extendible". It is considered that it is within the reach of one of ordinary skill in the art to construct extendible members. As already noted, these members can be nested within one another and telescopically project from within to extend their length. As another non-limiting alternative, the two members can be bound to one another by rings and slide relative to one another to extend their overall length. In yet another embodiment, the extendible member can be of the type which is folded in two or three and then unfolded to increase its length. These expedients are widely known in the art and do not require further explication. See FIGS. 11*p*, 11*q* and 11*r*. For example, in FIG. 11*q*, an extensible member 622 has a portion 622*a* and a portion 622*b*. The member 622*a* and 622 can be overlaid on each other to achieve a desired overall length of the member 622.

Also, as noted, the wheeling frame of the invention can built into a well formed in the rear of the suitcase, preferably located behind a zippered or closed panel, to provide the various features described above, similar to the teachings of the mentioned U.S. Pat. No. 6,446,987 patent whose contents are incorporated by reference herein. Previously described features can also be incorporated in the wheeling frame 500, as described above.

Further, although the handle system has been described to consist of two components, each of which can be separately pivoted, it should be recognized that a single handle system can also be implemented, preferably one which can be either pivoted out of the frame or drawn out of the frame and then pivoted through a desired angle and having its arms extendable as well. That single handle can also have the laterally extending piece which enables a user to walk alongside, rather than directly behind the suitcase. In the description of the leaning wheel assembly, the angular position is supported with the intermeshed gears. However, an additional arm can also be provided which has serration thereon (not shown) which can grab the connecting bar on the legs 582*a*, 582*b*.

It is also noted that an added benefit of the wheeling frame and its strap arrangement is that it would make it more difficult for airport personnel to quickly unzip the suitcase to pilfer its contents. The various straps would make that more difficult, particularly if the zipper pulling tabs on the suitcase were to be located toward the bottom, where the bottom, vertically traversing straps and the cross straps are located. There are many other advantages which should be apparent to those skilled in the art.

Although the present disclosure has been described with respect to particular or preferred embodiments thereof, many other variations, modifications, other and different combinations of the recited features, and other uses will become apparent to those skilled in the art in light of Applicant's instant disclosure. The disclosed embodiments are meant solely as illustrative of, and not limiting upon, the scope of the present disclosure, which is defined solely with reference to the appended claims.

What is claimed is:

1. A wheeling frame provided and existing separately from any suitcase and configured to be removably attached and disattached to and from a suitcase during normal use of a suitcase, the wheeling frame comprising:

a frame body, wherein the frame body is defined by structural frame members and the structural frame members of the frame body define an interior frame space which has a length, a width and depth, the frame body having one side generally planar for being placed against a backside of the suitcase and an opposed opposite side;

a wheeling leg assembly substantially stowable in the frame body in the interior frame space and movable between a first position substantially in the frame body and a second position extending away from the opposite side of the frame body, at an adjustable angle to the frame body;

at least one leaning wheel secured to the wheeling leg assembly;

a fastening system comprising a plurality of interlocking straps connected at one end of each strap to the frame body and configured to enable removable securing of the wheeling frame to the suitcase during normal use; and a wheeling frame openable bag attached only to the frame body, said bag substantially covering the frame body and the wheeling leg assembly and concealing it from view when the wheeling frame is attached to the suitcase.

2. The wheeling frame of claim 1, wherein the suitcase is rollable on its own load supporting wheels.

3. The wheeling frame of claim 1, wherein the wheeling leg assembly comprises first and second spaced legs, each having a respective leaning wheel secured thereto.

4. The wheeling frame of claim 1, including a handle assembly with an extendible handle.

5. The wheeling frame of claim 4, wherein the extendible handle has an extended length which is longer than half a length dimension of the wheeling frame.

6. The wheeling frame of claim 1, including a spring-biased mechanism configured to spring-bias the at least one leaning wheel to move to said second position.

7. The wheeling frame of claim 6, wherein said at least one leaning wheel is configured to allow said suitcase to be walked up a staircase such that the weight of said suitcase is always supported on one of and/or both said wheeling leg assembly and supporting wheels attached to said suitcase.

8. The wheeling frame of claim 2, wherein the wheeling leg assembly is structured to pivot out of the frame body about a pivot axis, and a locking mechanism structured to lock the wheeling leg assembly at a selectively adjustable angle position.

9. The wheeling frame of claim 8, wherein the position of the pivot axis including at least one anchor and the pivot axis of the wheeling leg assembly is adjustably movable along a section of the wheeling frame by moving the at least one anchor, in the frame body.

10. The wheeling frame of claim 1, wherein the frame body is defined by structural frame members and the structural frame members of the frame body define an interior frame space which has a length, a width and depth, wherein the depth of the frame body measures less than about 2 inches.

11. The wheeling frame of claim 1, wherein the plurality of interlocking straps are structured to grasp around and tightly secure the suitcase to the wheeling frame, and the straps extend outside the bag.

12. The wheeling frame of claim 11, wherein the plurality of straps include widthwise and lengthwise extending straps.

13. The wheeling frame of claim 1, wherein the openable bag comprises an openable front section.

14. The wheeling frame of claim 13, wherein the openable front section can be opened and closed using a fastener in the form of one of a zip fastener, snaps, or hook and loop fastener.

15. The wheeling frame of claim 14, wherein the fastener for the front section comprises first and second independently moveable zipper handles.

16. The wheeling frame of claim 15, wherein the front section can be rolled out and fastened in a position whereby a top section of the bag remains open during use of the wheeling frame.

17. The wheeling frame of claim 1, in combination with a suitcase having a recessed region on a rear side of said suitcase, and wherein the wheeling frame is structurally secured to the suitcase, at the recessed region of the suitcase.

* * * * *